US006429833B1

(12) United States Patent
Ryeom et al.

(10) Patent No.: US 6,429,833 B1
(45) Date of Patent: Aug. 6, 2002

(54) METHOD AND APPARATUS FOR DISPLAYING GRAY SCALE OF PLASMA DISPLAY PANEL

(75) Inventors: Jeong-duk Ryeom; Se-woong Kim, both of Cheonan (KR)

(73) Assignee: Samsung Display Devices Co., Ltd., Suwon (KR)

( * ) Notice: Subject to any disclaimer, the term of this patent is extended or adjusted under 35 U.S.C. 154(b) by 0 days.

(21) Appl. No.: 09/397,668

(22) Filed: Sep. 16, 1999

(30) Foreign Application Priority Data

Sep. 16, 1998 (KR) ..... 98-38198

(51) Int. Cl.[7] ..... G09G 3/28
(52) U.S. Cl. ..... 345/63; 345/60
(58) Field of Search ..... 345/63, 60, 148, 345/691, 473, 474, 475; 358/1.9; 348/674

(56) References Cited

U.S. PATENT DOCUMENTS

| | | | | |
|---|---|---|---|---|
| 5,446,344 A | | 8/1995 | Kanazawa | 315/169.4 |
| 5,702,059 A | * | 12/1997 | Chu et al. | 235/462 |
| 5,835,072 A | * | 11/1998 | Kanazawa | 345/60 |
| 6,134,024 A | * | 10/2000 | Miura et al. | 358/1.9 |
| 6,137,542 A | * | 10/2000 | Van Mourik | 348/674 |
| 6,144,364 A | * | 11/2000 | Otabe et al. | 345/691 |
| 6,215,469 B1 | * | 4/2001 | Mori et al | 345/148 |

FOREIGN PATENT DOCUMENTS

| | | |
|---|---|---|
| KR | 98-4289 | 3/1998 |

* cited by examiner

*Primary Examiner*—Steven Saras
*Assistant Examiner*—Chris Maier
(74) *Attorney, Agent, or Firm*—Leydig, Voit & Mayer, Ltd.

(57) ABSTRACT

A method and apparatus for displaying a gray scale of a plasma display panel, by which generation of a pseudo contour upon expression of a gray scale with respect to a moving picture is prevented when a picture is displayed on a plasma display panel. The method can prevent generation of pseudo contours of dark lines (or bright lines) so that a temporal inconsistency appears as spatial inconsistency, at a portion of a moving picture in which gray scale changes are subtle, when expressing a gray scale by temporal duplication of light emission using the after-image effect of vision. In view of the fact that a pseudo contour is generated because the movement of a pixel is not consistent with the movement of the human eye, and thus a temporal change in luminance is shown as dispersion of luminance on retinas, the present invention redistributes of sub-fields having the luminance of one cell to several cells, as many sub-fields corresponding to the inconsistency of the detected movement of a pixel with the movement of the eye. Accordingly, the movement of a pixel can be approximately consistent with the movement of the eye. Consequently, the retina of the eye can perceive the temporal stimulation of an original picture, so that pseudo contour phenomenon is reduced regardless of the moving speed of a picture.

8 Claims, 35 Drawing Sheets

[ 31 32 64 64 32 32 ]

LENA ORIGINAL IMAGE

WHEN THERE IS NO COUNTERMEASURE

SPEED(P/F)V=5

CONVENTIONAL METHOD
SUB-FIELD CONTROL (10-BIT)

SPEED(P/F)V=5

METHOD OF PRESENT INVENTION
WHEN THERE IS NO COUNTERMEASURE

SPEED(P/F)V=5

A=[127 127.....127], V=0
B=[127 127.....127], V=5
C=[127 127.....127], V=0

GRAY SCALE IS LOWERED IN THE MIDDLE

PSNR=25.0044

OUTDATA=[

127 127 127 127 127 127 127 127 127 127 127 127
127 127 96 64 127 127 127 127 127 127 127 127]

GRAY SCALE IS LOWERED IN THE FIRST HALF

PSNR=20.6905

OUTDATA=[

127 127 127 127 127 127 127 127 31 63 127 127
127 127 96 64 127 127 127 127 127 127 127 127]

A=[127 127.....127], V=0
B=[128 128.....128], V=5
C=[127 127.....127], V=0

GRAY SCALE IS
LOWERED IN THE MIDDLE

OUTDATA=[

127 127 127 127 127 127 127 127 64 128 128 128
128 128 128 128 191 127 127 127 127 127 127 127]

GRAY SCALE IS
LOWERED IN THE
FIRST HALF

PSNR=15.0175

OUTDATA=[

127 127 127 127 127 127 127 127 0 0 64 128
127 127 96 64 127 127 127 127 127 127 127 127]

A=[128 128.....128], V=0
B=[128 128.....128], V=5
C=[128 128.....128], V=0

GRAY SCALE IS
LOWERED IN THE MIDDLE

OUTDATA=[
128 128 128 128 128 128 128 128 64 128 128 128
128 128 128 128 128 128 128 128 128 128 128 128]

GRAY SCALE IS
LOWERED IN THE
FIRST HALF

PSNR=16.2669

OUTDATA=[
128 128 128 128 128 128 128 128 0 0 64 128
128 128 128 128 128 128 128 128 128 128 128 128]

A=[128 128.....128], V=0
B=[127 127.....127], V=5
C=[128 128.....128], V=0

GRAY SCALE IS
LOWERED IN THE MIDDLE

OUTDATA=[
128 128 128 128 128 128 159 191 127 127 127 127
128 128 128 128 128 128 128 128 128 128 128 128]

GRAY SCALE IS
LOWERED IN THE
FIRST HALF

PSNR=20.6898

OUTDATA=[
128 128 128 128 128 128 128 128 31 63 127 127
127 127 127 127 127 127 128 128 128 128 128 128]

METHOD AND APPARATUS FOR DISPLAYING GRAY SCALE OF PLASMA DISPLAY PANEL

BACKGROUND OF THE INVENTION

1. Field of the Invention

The present invention relates to a method and apparatus for displaying gray scales of a plasma display panel to prevent pseudo-contour from being generated when a moving picture is expressed on the plasma display panel in gray scales.

2. Description of the Related Art

Plasma display panels are display devices which arrange a plurality of discharge cells in a matrix and selectively make the arranged discharge cells emit light, thereby restoring video data input as an electrical signal. The plasma display panel can be driven by a DC driving method or an AC driving method according to whether the polarity of a voltage applied to maintain discharge is changed or not according to time. The plasma display panel can be classified into an opposite discharge type and a surface discharge type according to the method of arranging electrodes for generating discharge. Each type is also classified into a two-electrode structure, a three-electrode structure, or the like according to the number of electrodes installed.

FIG. 1A is a cross-sectional view of a discharge cell in a DC-type opposite discharge plasma display panel, and FIG. 1B is a cross-sectional view of a discharge cell in an AC-type surface discharge plasma display panel. As shown in FIGS. 1A (1B), the plasma display panel essentially includes discharge spaces 3 (13) between a front glass substrate 1 (11) and a rear glass substrate 2 (12). The DC-type opposite discharge display panel, as shown in FIG. 1A, fundamentally has two orthogonal electrodes 4 and 5 which are installed on the front and rear glass substrates 1 and 2, respectively. The two electrodes 4 and 5 are directly exposed to the discharge space 3, such that a discharge is sustained due to flow of electrons provided by a cathode. The AC-type surface plasma display panel, as shown in FIG. 1B, includes an address (metal) electrode 14 installed on the glass substrate 11, and a pair of discharge sustaining electrodes 15 installed on the glass substrate 12 to be orthogonal to the address electrode 14. The discharge sustaining electrodes 15 are covered by a dielectric layer 16, such that they are electrically isolated from the discharge space 13. In this case, a sustaining discharge occurs between the two discharge sustaining electrodes 15 installed within the dielectric layer 16, and is sustained by an effect (wall charge effect) due to a charge being accumulated on the surface of the dielectric layer. That is, even when a voltage lower than a discharge start voltage is applied, discharge occurs where a wall charge exists, since the discharge start voltage is the sum of the applied voltage and a wall voltage generated by the wall charges. The discharge also accumulates a negative-polarity wall charge, so that discharge is repeated and sustained where discharge occurs once.

FIG. 2 is an exploded perspective view of the three-electrode surface discharge plasma display panel shown in FIG. 1B, which is already in common use. This structure includes two discharge sustaining electrodes 15 formed parallel to each other within a discharge space formed by barrier ribs, and an address electrode 14 facing the discharge sustaining electrodes 15 to be orthogonal thereto. A fluorescent body 18 that emits red, green and blue lights by ultraviolet rays emitted during discharge, is coated within discharge spaces separated by the barrier ribs 17.

FIG. 3 is a connection diagram of electrodes of the AC-type surface discharge plasma display panel of FIG. 2. As shown in FIG. 2, several pairs of electrodes 15 are horizontally installed on a rear glass substrate, and two electrodes in each pair face each other in parallel. The electrodes 14 in strips are installed on a front glass substrate in a direction orthogonal to the electrodes 15. Here, electrodes connected commonly to each other, among the pairs of horizontal electrodes 15, are common electrodes (X electrodes), and the other electrodes separated from each other are scanning electrodes (Y electrodes). Also, electrodes perpendicular to these X and Y electrodes are address electrodes 14. In this structure, a discharge for generating wall charge to select a pixel occurs between an address electrode 14 and a scanning electrode, and thereafter, a discharge for displaying pictures repeatedly occurs for a certain time between the scanning electrode and the common electrode. The barrier ribs 17 form discharge spaces and also prevent crosstalk between adjacent pixels by blocking light generated during discharge. A plurality of unit structures are formed on one substrate in a matrix, and ultraviolet rays emitted from the respective unit structures selectively discharge a fluorescent material coated on spaces between adjacent barrier ribs, thereby accomplishing color. These unit structures act as pixels, and these pixels are collected and become a plasma display panel.

The plasma display panel having such a structure must be able to display gray scales in order to provide the performance of a color display device. Display of gray scales is accomplished using a gray scale expressing method of dividing one field into a plurality of sub-fields and time-division controlling them.

FIG. 4 shows a method of displaying a gray scale of an AC-type surface discharge plasma display panel. Here, the horizontal axis denotes time, and the vertical axis denotes the number of horizontal scan lines. In the gray scale display method of FIG.4 which is an 8-bit gray scale expression method, one field is divided into eight sub-fields, and each sub-field is comprised of an address period and a charge sustaining period. The addressing period forms a wall charge on a pair of display electrodes at a selected place on the entire screen of a plasma display panel due to selective discharge by a writing pulse, to thus write electrical-signalized information (that is, to form wall charges) between the address electrode and the scanning electrode which cross each other. The discharge sustaining period is a light emitting period which realizes image information on a real screen by discharging continuous discharge sustaining pulse between the display electrodes. The discharge sustaining period has a light emitting period ratio of 1:2:4:8:16:32:64:128. According to the principle in which a gray scale of a PDP is realized, the sub-fields are selectively driven, and at this time, emitted light is perceived for a predetermined time by the eyes of a user, so that the user perceives a gray scale as an averaged luminance. For example, in order to accomplish a gray scale of 3, an auxiliary field having a period of 1T and an auxiliary field having a period of 2T are driven, and the sum of the periods is made 3T, so that a gray scale 3 is perceived which is expressed as the amount of exposure light during a period of 3T. In the same way, a gray scale of 127 as a luminance of 127 is obtained by the amount of light exposed during a total of 127T periods by sequentially driving sub-fields having periods of 1T, 2T, 4T, 8T, 16T, 32T and 64T. When 8 sub-fields are used in this way, a total of 256 gray scales ($2^8$=256) can be displayed.

Meanwhile, FIGS. 5A through 5C are graphs for explaining a principle in which the human eye perceives a gray scale of a still picture. It is assumed that pixel A has a brightness of 127 and pixel B has a brightness of 128. In the pixel A, all sub-fields in the first half except for an auxiliary field having a period of 128T, among 8 sub-fields, emit light, and in the pixel B, only the auxiliary field in the second half having a period of 128T emits light, as shown in FIG. 5A. When these pixels are temporally at pause, the human eye senses light during a predetermined period at a certain position on the retina as shown in FIG. 5B, and thus can properly perceive the correct stimulated values, that is, brightnesses of 127 and 128, as shown in FIG. 5C.

FIG. 6 is a graph explaining a principle in which the human eye perceives a gray scale when a pixel moves. Referring to FIG. 6, if a pixel moves in a sequence of 1, 2, 4, 8, . . . , the human eye instinctively moves after this bright pixel. However, in contrast with the movement of this pixel, the human eye moves linearly and thus has a movement path such as a dotted line (B). As a consequence, the shape of the pixel landing on the retina is shown in FIG. 7A, and the luminance distribution according to a pixel on the retina is shown in FIG. 7B.

FIG. 8 is a graph showing the luminance finally perceived by the human eye when a pixel having a gray scale of 128 and a pixel having a gray scale of 127 adjacently move from left to right. In the first and second light emitting cells between 0F and 1F, sub-fields having periods of 1T, 2T, 4T, 8T, 16T, 32T and 64T stop emitting light, and only an auxiliary field having a period of 128T emits light, that is, only the second half emits light (which is indicated by the slashed portion), thus displaying a gray scale of 128. In the third and fourth light emitting cells between 0F and 1F, sub-fields having periods of 1T, 2T, 4T, 8T, 16T, 32T and 64T in the first half emit light, that is, only the first half emits light (which is indicated by the slashed portion), and an auxiliary field having a period of 128T in the second half stops emitting light, thus displaying a gray scale of 127. In this case, the human eye moves along a slanted line direction (direction B), so that the luminance distribution obtained on the retina is as shown in FIG. 9A. In this case, a discontinuous plane of brightness is generated as indicated by the slanted line (in direction B). Consequently, visual stimulation obtained on the retina is as shown in FIG. 9B, and a dark portion 0 is generated between gray scales of 128 and 127. The human eye perceives this situation as a dark band of 0 existing while a gray scale smoothly changes from a brightness of 128 to a brightness of 127. A contour that does not actually exist but is perceived by the human eye as a pixel moves, is called a pseudo contour. In accordance with this principle, a bright band of 255 is perceived by the human eye when a gray scale changes from a brightness of 127 to a brightness of 128.

FIG. 10A is a graph showing a representation of the pseudo contour phenomenon by a computer simulation when a band-shaped gray scale pattern changing from a brightness of 0 to the highest brightness of 255 in stages moves from left to right. FIG. 10B shows a variation in the luminance of a gray scale pattern when a picture is paused, wherein the horizontal axis indicates gray scales within stages of 0 to 255 and the vertical axis indicates the relative values of luminance. When a picture moves from left to right, the human eye perceives a gray scale pattern as shown in FIG. 10C. That is, some bright bands originally not existing are recognized by human's eyes. FIG. 10D is a graph showing a variation in the luminance of this gray scale pattern, wherein abnormal peaks corresponding to the pseudo contour are generated along a line of luminance that linearly changes according to a gray scale stage.

FIGS. 11A through 11C are configuration diagrams of an auxiliary field constituted by conventional methods for reducing generation of the pseudo contour. In one conventional method for reducing generation of the pseudo contour, sub-fields 46 and 128 having a relatively long luminous time in an original auxiliary field sequence shown in FIG. 11A are divided into a plurality of identical gray scales 48 having short luminous times, as shown in FIG. 11B. In another conventional method, the sub-fields segmented, as shown in FIG. 11B, are rearranged, as shown in FIG. 11C. The method of FIG. 11C can reduce the distance of movement of light emitting portions when luminance changes, thus preventing the temporal non-uniformity of a light emitting pattern. However, according to these methods, a reduction in the pseudo contour is small, as shown in FIGS. 12A and 12B, and the pseudo contour phenomenon becomes serious with an increase in the speed, as shown in FIGS. 13A through 13D and FIGS. 14A through 14D. FIGS. 13A through 13D are graphs showing the pseudo contour when a field is divided into sub-fields, as shown in FIG. 11B, and the speeds V (=P/F) of pixels are 2, 3, 4 and 5. Referring to FIGS. 13A through 13D, the pseudo contour increases with an increase in speed, which means a degradation in the quality of image. FIG. 14A through 14D are graphs showing the pseudo contour when the sub-fields are divided and rearranged, as shown in FIG. 11C, and the speeds V (=P/F) of pixels are 2, 3, 4 and 5. Referring to FIGS. 14A through 14D, the pseudo contour increases with an increase in speed, which means a degradation in the quality of image.

As described above, these conventional pseudo contour reducing methods have weak effects so that the pseudo contour can be detected with the naked eye. Also, these conventional methods have a problem in that the pseudo contour phenomenon increases in proportion to the movement speed of a pixel.

SUMMARY OF THE INVENTION

An objective of the present invention is to provide a method and apparatus for displaying a gray scale of a plasma display panel, to reduce a pseudo contour having dark lines (or bright lines) by temporal nonuniformity which causes spacial nonuniformity at a portion of a moving picture where a gray scale change is subtle.

Accordingly, to achieve the above objective, the present invention provides a method of displaying a gray scale of a time-division plasma display panel, in which a picture in each field displayed on the plasma display panel is divided into a plurality of sub-fields such that each sub-field has a temporally different charge sustaining period, and a gray scale is thus displayed by the combination of the sub-fields, the method including the step of: dispersing and arranging image information representing a picture at an arbitrary position on one field, to each of the sub-fields constituting the field, wherein the image information position on each of the sub-fields sequentially moves from a first display position where the image information has been displayed on a field just before the field, to a third display position where the image information is expected to be displayed on a field just next to the field, via a second display position where the image information is displayed on the field.

In the present invention, it is preferable that the position of the image information displayed on each of the sub-fields is determined such that the image information sequentially moves from the first display position to the third display position according to the moving speed of image information set among the first, second and third display positions.

Preferably, the image information position on each of the sub-fields is determined such that the image information sequentially moves from the first display position to the position before the second display position on sub-fields corresponding to the time for the first half of the corresponding field, and the image information sequentially moves from the second display position to the third display position on sub-fields corresponding to the time for the second half of the corresponding field. It is preferable that the image information position displayed on each of the sub-fields is set as a position where the image information moves according to control information determined by the functional relation set with respect to the characteristic values of sub-fields constituting the corresponding field. Preferably, the image information position on each of the sub-fields is determined to have an arrangement in which luminance temporally looks consistent or nearly consistent with respect to the display time of the corresponding field. It is preferable that the discharge sustaining period of each of the sub-fields is determined so as to have an arrangement in which luminance temporally looks consistent or nearly consistent with respect to the display time of the corresponding field.

In the present invention, when a field just before the previous field on which the first display position exists is called a zero order field, and a field just before the zero order field is called a −1 order field, the motion of the zero order field or the motions of the zero order and −1 order fields is detected, the position of image information displayed on each of the sub-fields is previously estimated by displaying the motion vector on a straight line or curve of the detected motion between the first and third display positions via the second display position, and the position of image information displayed on each of the sub-fields is determined by the estimation that the image information sequentially moves from the first display position to the third display position via the second display position.

To accomplish the above objective, the present invention provides an apparatus for displaying a gray scale of a time-division plasma display panel, the apparatus includes: a video signal input portion for separating only a pure video signal from a composite video signal; an analog-to-digital (A/D) converter for converting an analog video signal separated by the video signal input portion, into a digital video signal; a gamma correction means for correcting the video signal, suitable for the driving characteristics of a cathode ray tube, provided by the A/D converter to be suitable for the characteristics of a plasma display panel; a picture level detection means for detecting the total brightness of a picture from the gamma-corrected signal; a power controller for converting data of a video signal provided by the picture level detection means, the power controller having a power control (APC) function; a motion vector detection means for detecting the moving direction and speed of corresponding image information by the comparison of image display information received at the corresponding field with image information received at a field prior to the corresponding field, in each field of the video signal provided by the gamma correction means; a picture data rearrangement means for dispersing and rearranging pixel data provided by the power controller to several sub-fields according to the directional vector of a picture provided by the motion vector detection means; a sub-field converter for rearranging a rearranged picture signal provided by the picture data rearrangement means in each sub-field; a pulse timing control means for generating a reference timing signal of a driving pulse for driving the electrodes of a plasma display panel on the basis of a signal provided by the power controller; a discharge sustaining pulse generation means for generating a discharge sustaining pulse for driving discharge sustaining electrodes on the basis of the reference timing signal provided by the pulse timing control means; a scanning electrode driving means for directly driving scanning electrodes using the discharge sustaining pulse; an address electrode driving means for driving address electrodes using the reference timing signal provided by the pulse timing control means and a sub-field video signal provided by the sub-field conversion means; and a plasma display panel, wherein a picture on each field displayed on the plasma display panel is divided into a plurality of sub-fields, each of the sub-fields having a temporally different discharge sustaining period, and a gray scale is displayed by the combination of the different discharge sustaining periods.

In the present invention, the picture data rearrangement means includes: a means for moving the position of information displayed on each of the sub-fields at the detected moving speed and in the detected moving direction; a means for storing display information moved with respect to every information within one field; and a means for reconstructing image information for one field using the stored display information.

BRIEF DESCRIPTION OF THE DRAWINGS

The above object and advantages of the present invention will become more apparent by describing in detail a preferred embodiment thereof with reference to the attached drawings in which:

FIGS. 10A through 10D are views showing pseudo contour phenomenon represented by a computer simulation when a band-shaped gray scale pattern changing from a brightness of 0 to the highest brightness of 255 in stages moves from left to right; wherein FIG. 10A is a view showing a picture which continuously displays 256 original gray scales;

FIG. 10B is a graph showing a variation in the luminance of a gray scale pattern when a picture is at pause;

FIG. 10C shows a gray scale pattern perceived by the human eye when a continuous picture of 256 gray scales as shown in FIG. 10A moves from left to right;

FIG. 10D is a graph showing a variation in the luminance of the gray scale pattern of FIG. 10C;

FIGS. 11A through 11C are configuration views of sub-fields used in conventional methods for reducing a pseudo contour phenomenon, wherein FIG. 11A shows a conventional original auxiliary field sequence;

FIG. 11B shows a method of dividing gray scales of 64 and of 128 each having a relatively long light emitting time into a plurality of identical gray scales of 48 having short light emitting times and displaying the segmented identical gray scales of 48;

FIG. 11C shows the segmented sub-fields of FIG. 11B which are rearranged;

FIGS. 19A through 19D are views showing results of a pseudo contour phenomenon on which an experiment is made by applying the method of FIG. 17, wherein FIG. 19A shows a gray scale by spatially dispersing sub-fields;

FIG. 19B shows luminance distribution which lands on the retina of a human eye and perceived by the human eye due to the dispersion of sub-fields as shown in FIG. 19A;

FIG. 19C shows a picture having a continuous gray scale pattern that FIG. 19B originally intended to display;

FIG. 19D is a graph showing the intensity distribution of visual stimulation received by the retina of a human eye due to the luminance distribution on the retina as shown in FIG. 19B;

FIGS. 20A and 20B are views showing results of an experiment in which a gray scale pattern uniformly changing in brightness from 0 to 255 is displayed by a gray scale displaying method according to the present invention, wherein FIG. 20A shows a uniform gray scale pattern in which pseudo contour is almost reduced;

FIG. 20B is a graph showing a luminance distribution curve in which much pseudo contour noise is reduced;

FIGS. 21A through 21D are luminance distribution curves showing results of experiments made on the generation characteristics of pseudo contour according to the present invention at a pixel which moves at different speeds, wherein FIG. 21A is a view when V(P/F) is two;

FIG. 21B is a view when V(P/F) is three;

FIG. 21C is a view when V(P/F) is four;

FIG. 21D is a view when V(P/F) is five;

FIGS. 23A through 23D are photographs showing results of an experiment made with a test picture to verify the effects of a method of displaying a gray scale of a plasma display panel according to the present invention, wherein FIG. 23A is a photograph showing an original picture used in the experiment;

FIG. 23B is a photograph showing a picture in which serious pseudo contour is generated by applying a conventional gray scale display method having no countermeasures for reducing pseudo contour;

FIG. 23C is a photograph showing a picture in which pseudo contour is still generated when a conventional countermeasure for reducing pseudo contour is applied;

FIG. 23D is a photograph showing a picture in which pseudo contour is hardly generated when a countermeasure for reducing pseudo contour according to the present invention is applied;

DESCRIPTION OF THE PREFERRED EMBODIMENT

Luminance stimulation is dispersed like a parallelogram at a temporal inclination and received by the retina of a human eye according to the speed of a picture under the influence of the temporal distribution of a gray scale in a moving picture due to the characteristics of a plasma display panel, which causes generation of pseudo contour. Using this fact, the present invention is devised to realize a moving pixel in a rectangular shape on real retinas by previously making a pixel have a distribution state shaped of a parallelogram having an inclination (B) on the graph of FIG. 15

(i.e., movement speed) in consideration of the characteristics of the human eye when the pixel moves on a screen. That is, the present invention removes a pseudo contour phenomenon in principle.

Figure 1A:
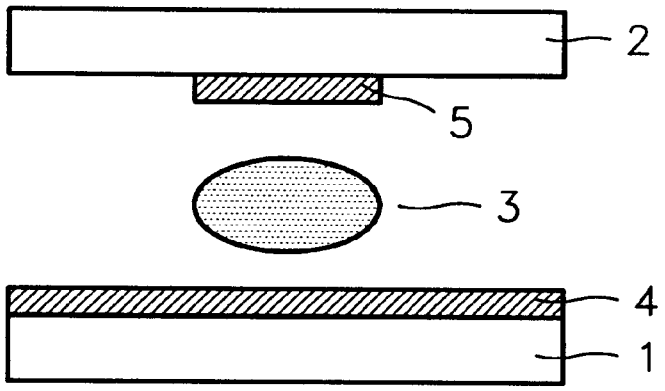
FIG. 1A is a vertical section view of a discharge cell in a DC-type opposite discharge plasma display panel.
Figure 1B:
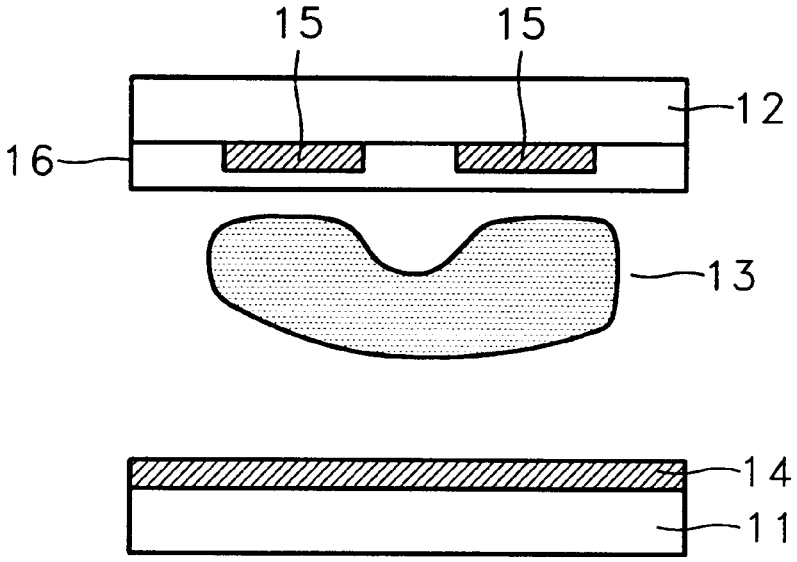
FIG. 1B is a vertical section view of a discharge cell in an AC-type surface discharge plasma display panel.
Figure 2:
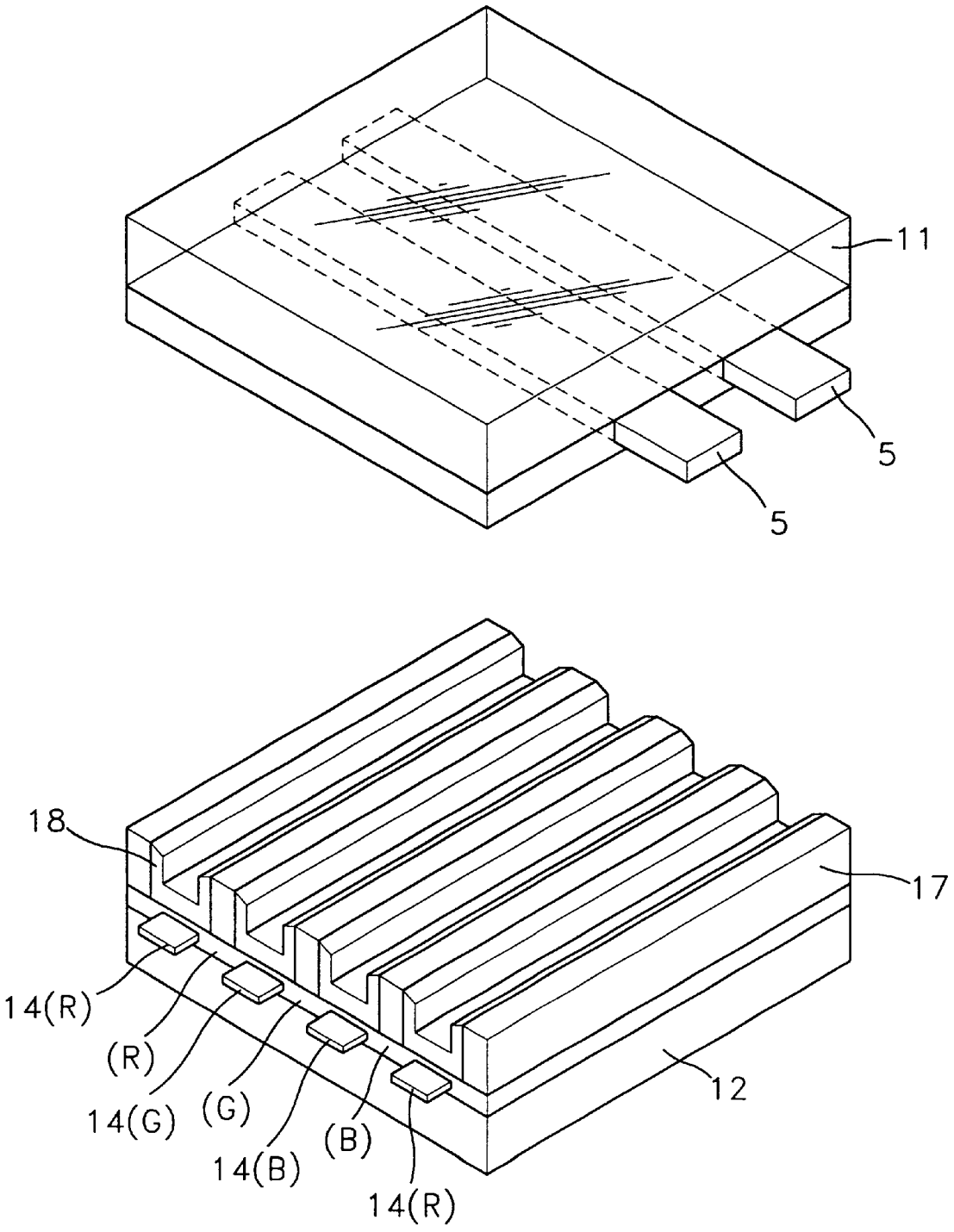
FIG. 2 is an exploded perspective view of a three-electrode surface discharge plasma display panel shown in FIG. 1B.
Figure 3:
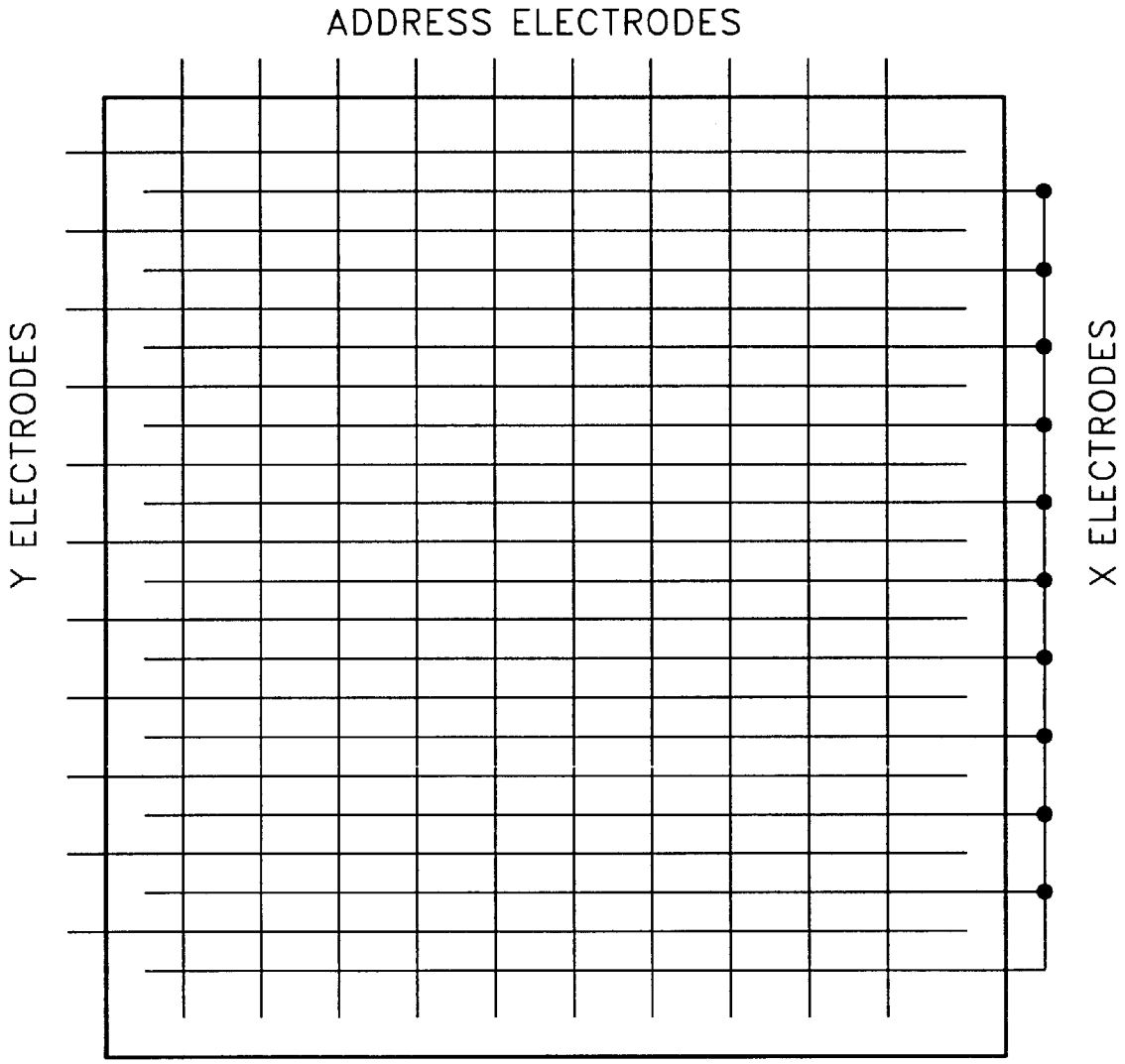
FIG. 3 is a connection diagram of electrodes of the AC-type plasma display panel of FIG. 2.
Figure 4:
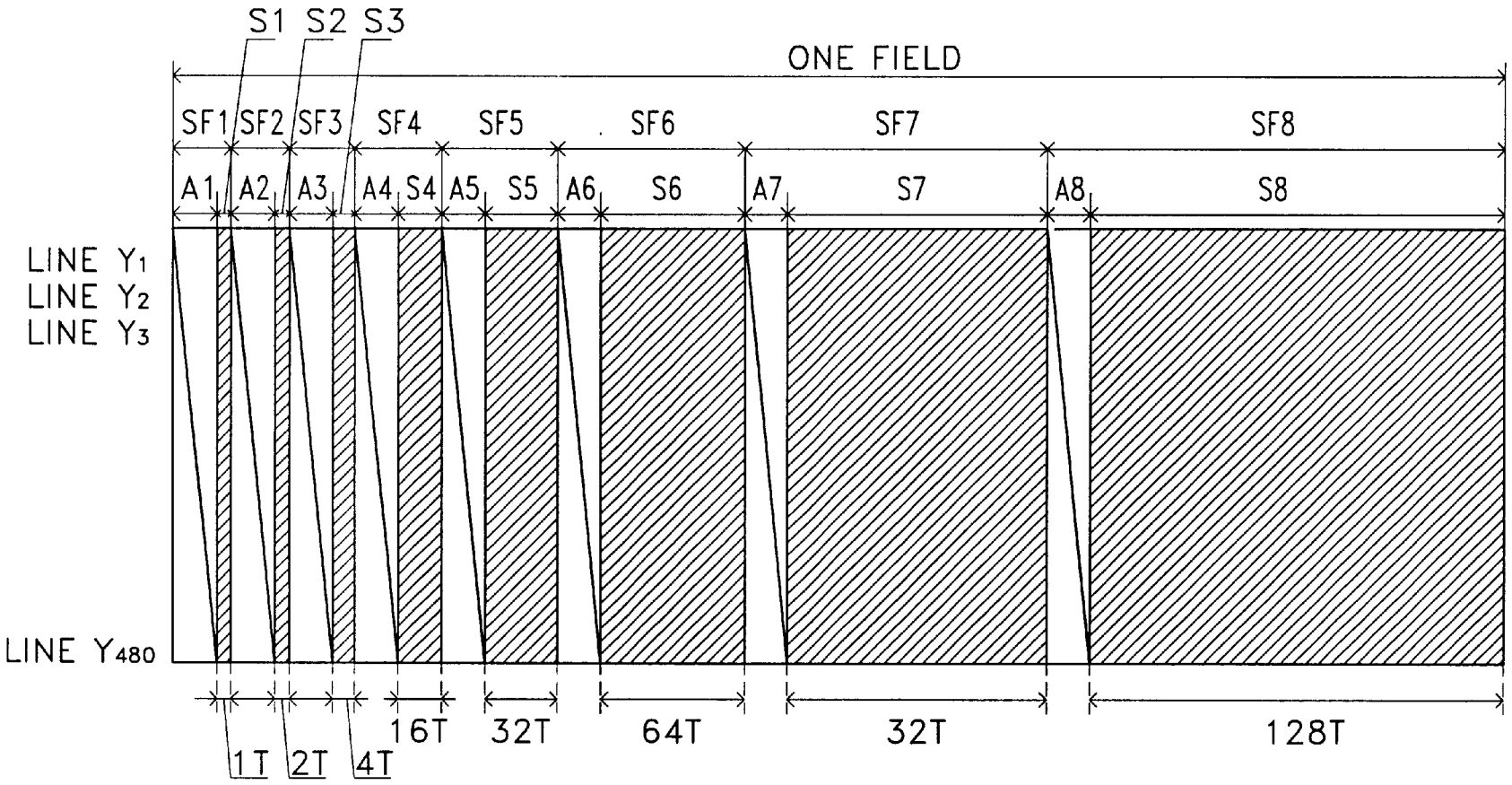
FIG. 4 is a view illustrating a method of displaying a gray scale of an AC-type surface discharge plasma display panel.
Figure 5A:
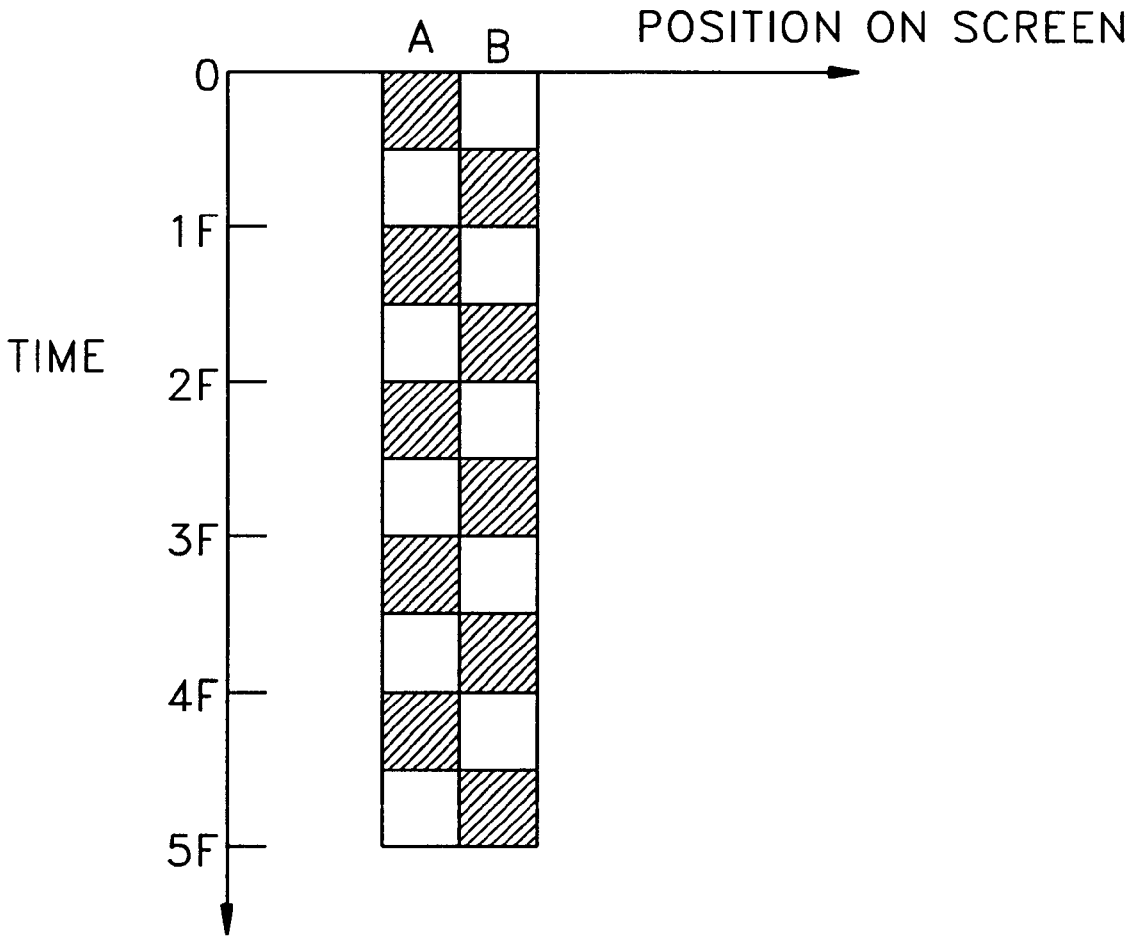
FIGS. 5A through 5C are views for explaining a principle in which the human eye perceives a gray scale of a still picture.
Figure 5B:
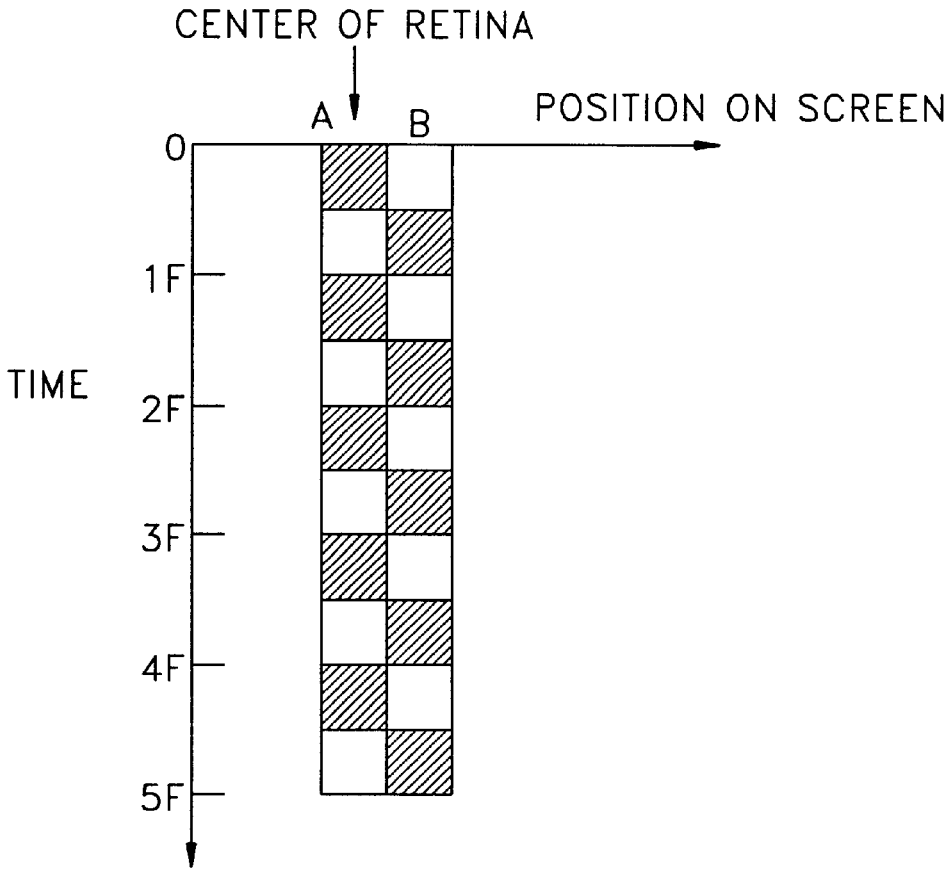
Figure 5C:
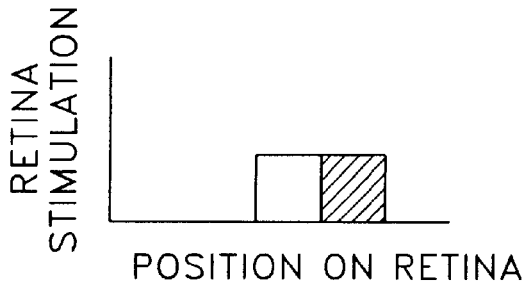
Figure 6:
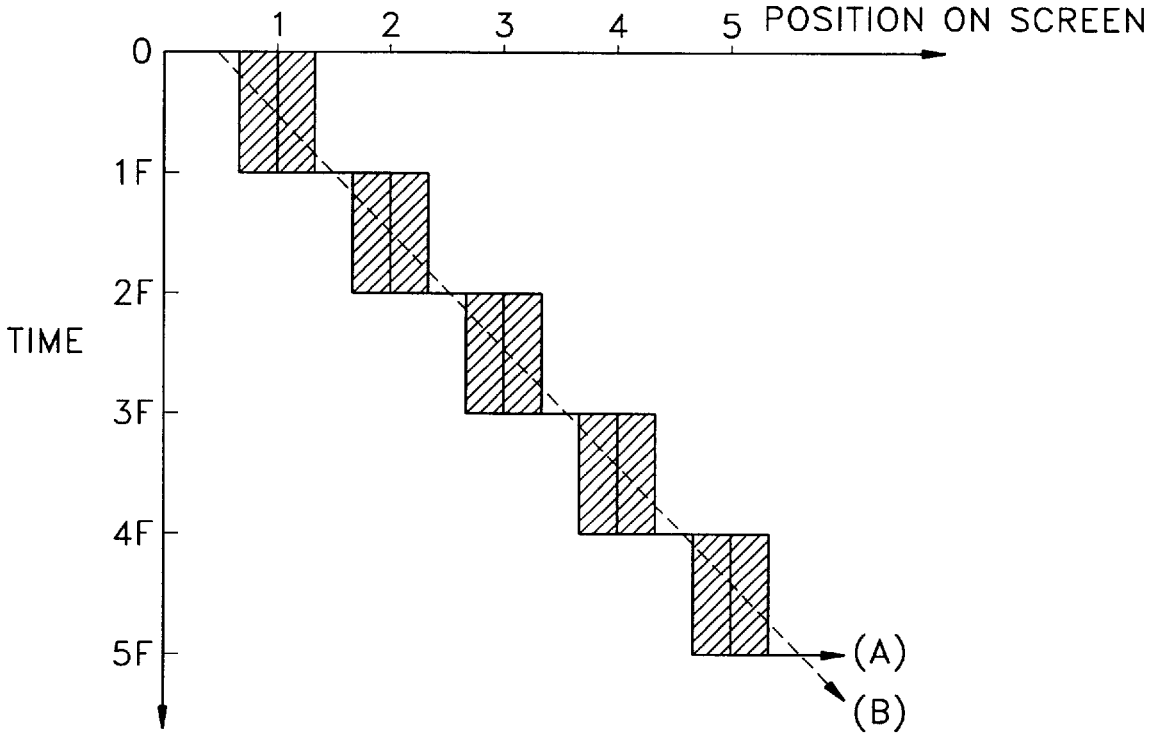
FIG. 6 is a view for explaining a principle in which the human's eye perceives a gray scale when a pixel moves.
Figure 7A:
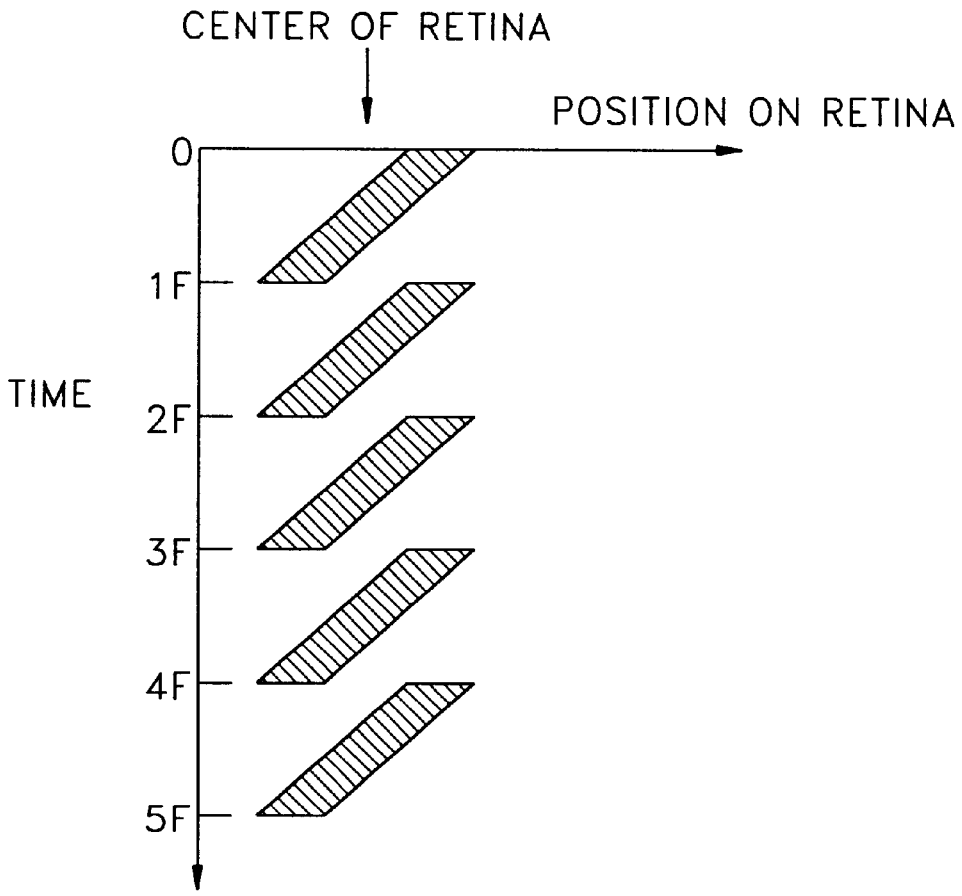
FIG. 7A is a view showing the shape of a pixel landing on the retina of a human eye when a method of displaying a gray scale of a picture shown in FIG. 6 is applied.
Figure 7B:
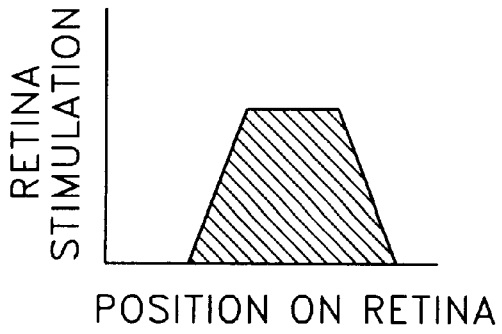
FIG. 7B is a graph showing the luminance of a pixel on the retina.
Figure 8:
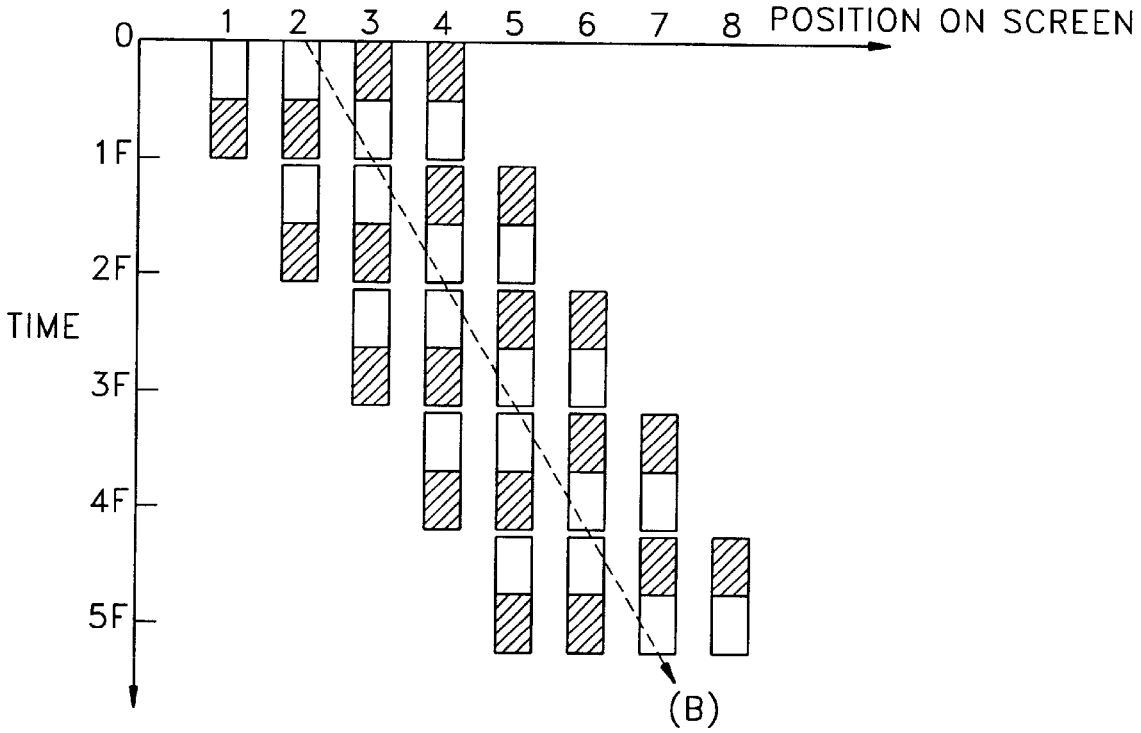
FIG. 8 is a view for explaining a principle in which the human eye perceives a gray scale when a pixel having a gray scale of 128 and a pixel having a gray level of 127 adjacently move from left to right.
Figure 9A:
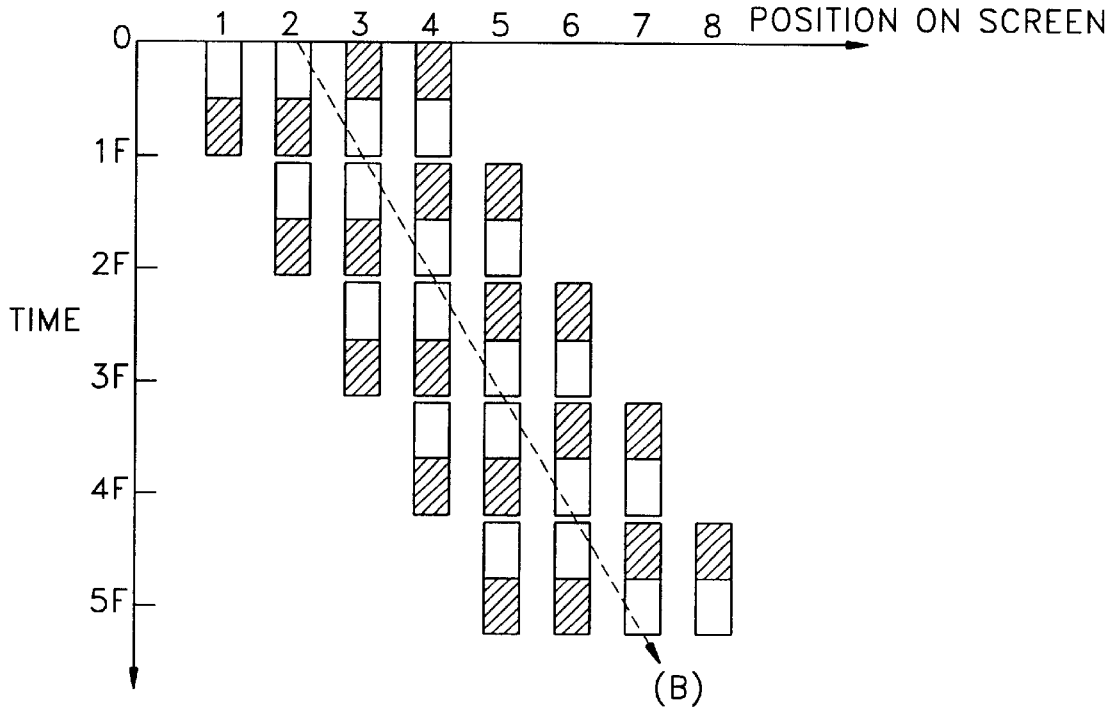
FIG. 9A is a view for explaining a principle in which the human eye perceives a gray scale when adjacent pixels having gray levels of 128 and 127 shown in FIG. 8 are displayed.
Figure 9B:
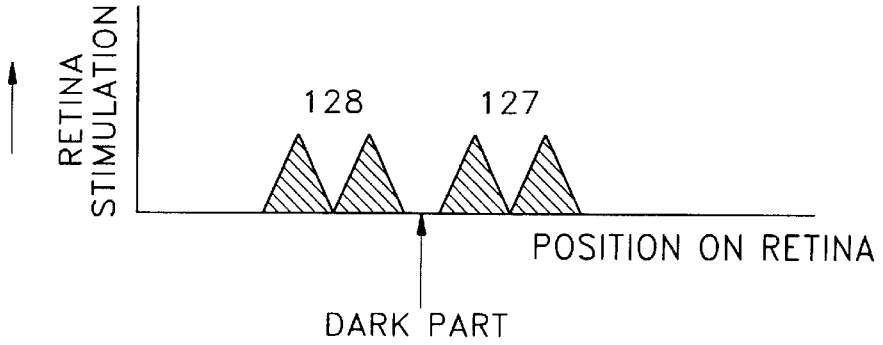
FIG. 9B is a graph showing a luminance distribution obtained on the retina of a human eye according to FIG. 9A.
Figure 10A:
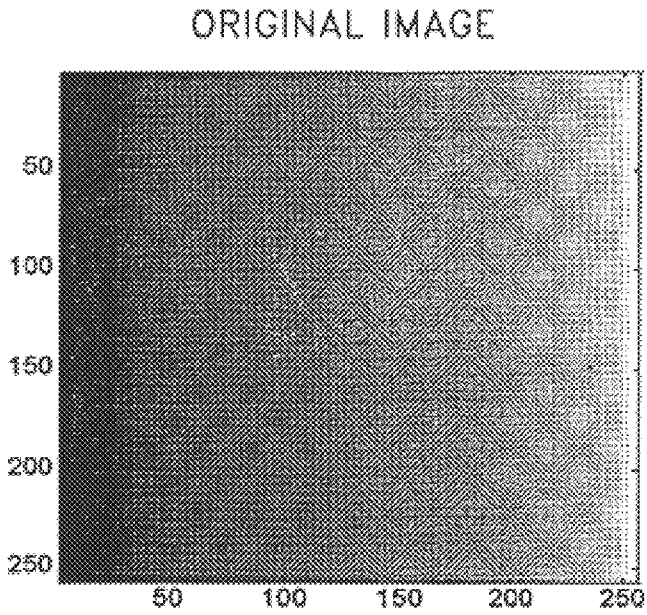
Figure 10B:
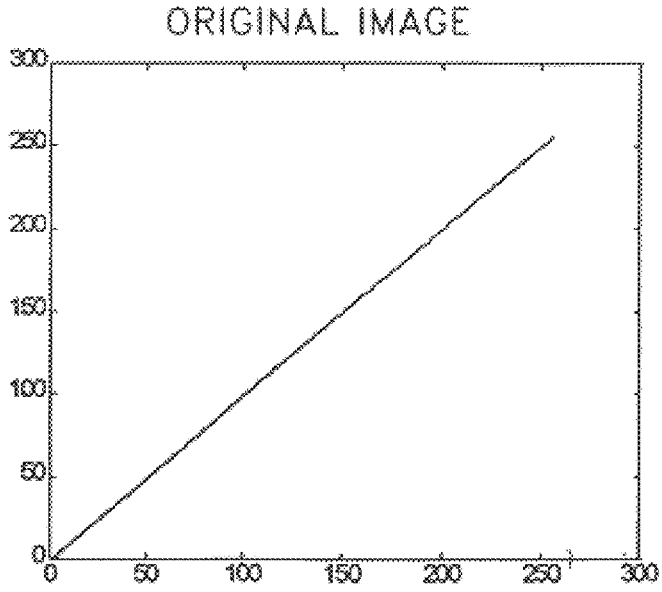
Figure 10C:
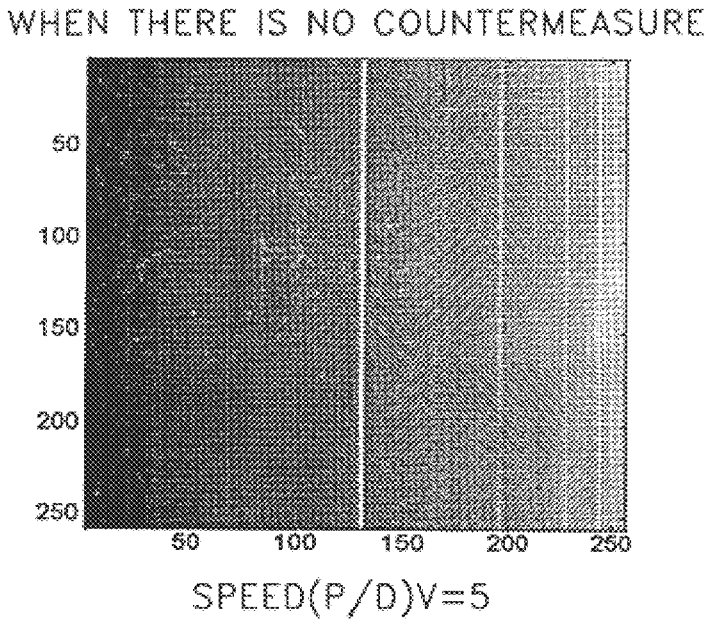
Figure 10D:
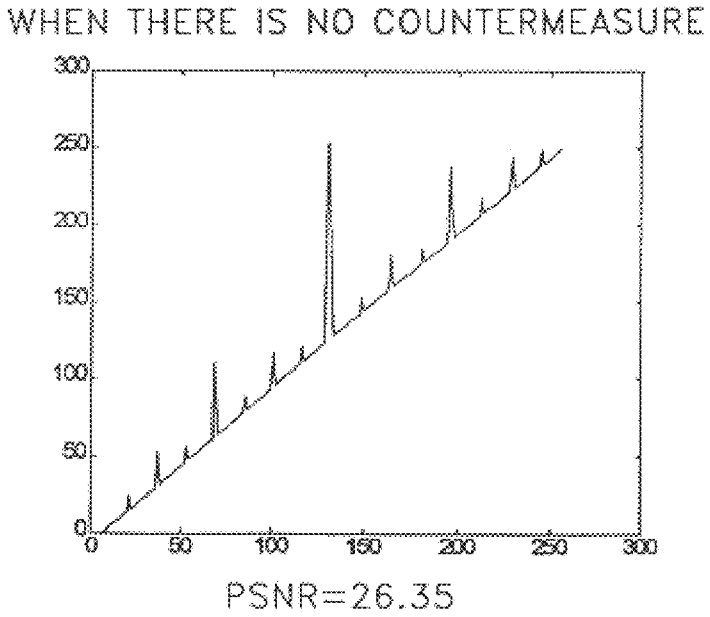
Figure 11A:
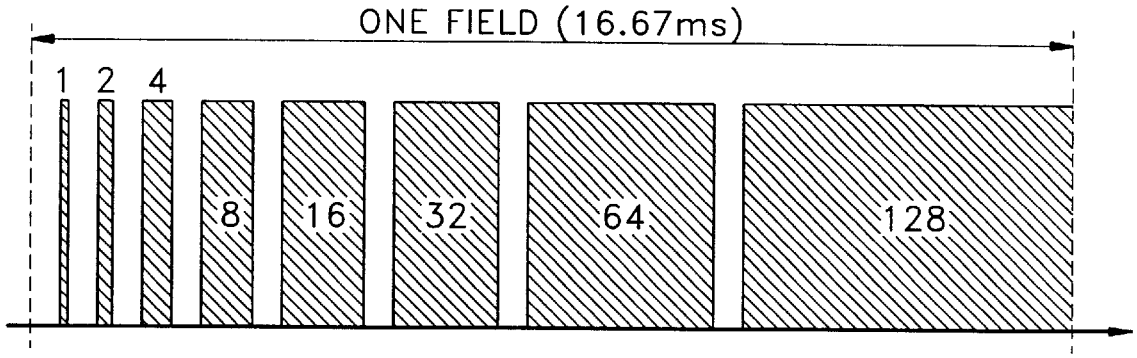
FIG. 11A (PRIOR ART)
Figure 11B:
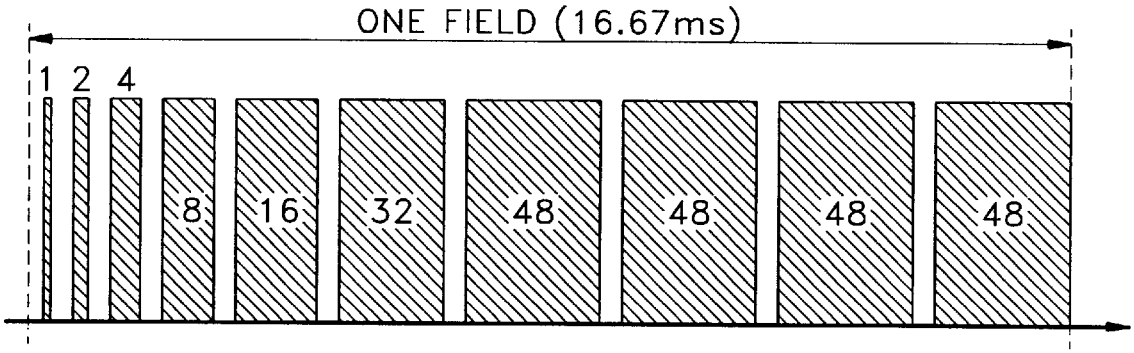
FIG. 11B (PRIOR ART)
Figure 11C:
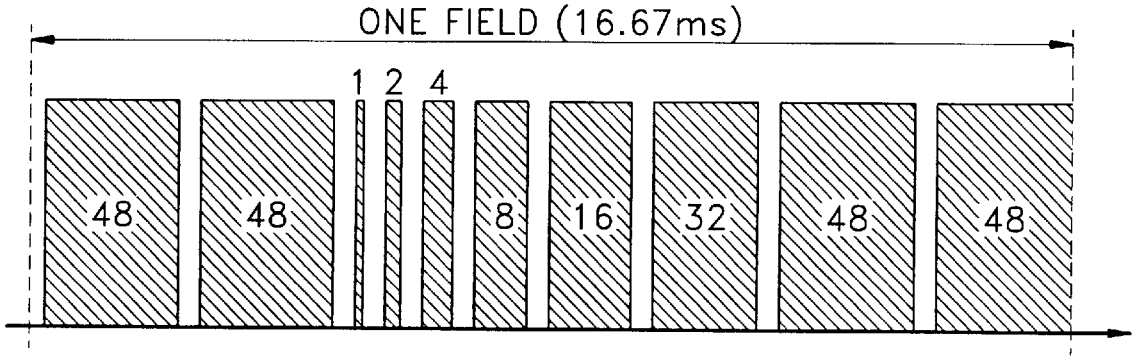
FIG. 11C (PRIOR ART)
Figure 12A:
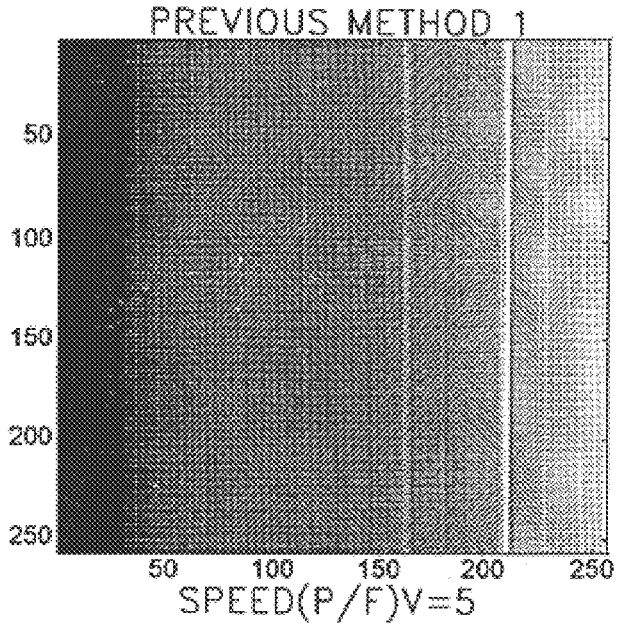
FIG. 12A (PRIOR ART)
FIGS. 12A and 12B are graphs showing a resultant picture displayed by the segmented sub-fields of FIG. 11B and the luminance distribution of the picture.
Figure 12B:
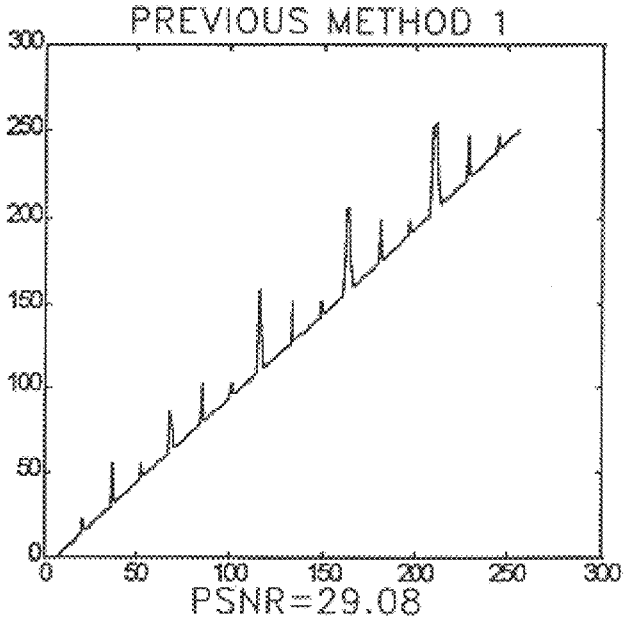
FIG. 12B (PRIOR ART)
Figure 13A:
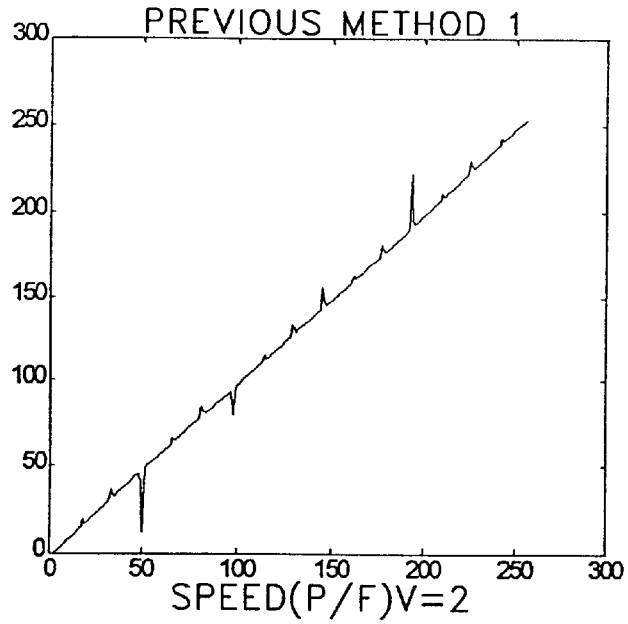
FIG. 13A (PRIOR ART)
FIGS. 13A through 13D are graphs showing resultant luminance distributions displayed by the segmented sub-fields of FIG. 11B when the movement speeds (P/F) of pixels are 2, 3, 4 and 5.
Figure 13B:
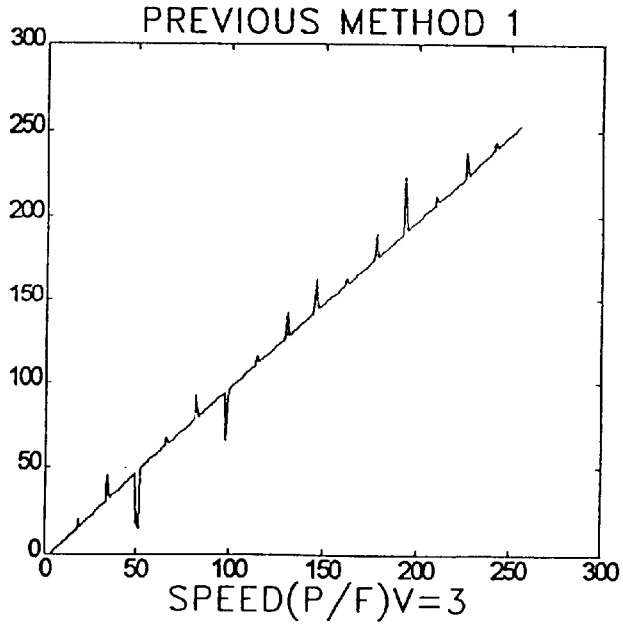
FIG. 13B (PRIOR ART)
Figure 13C:
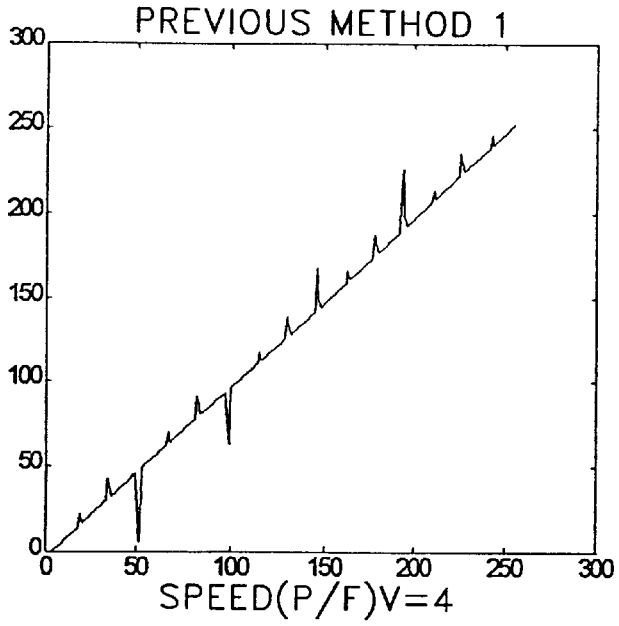
FIG. 13C (PRIOR ART)
Figure 13D:
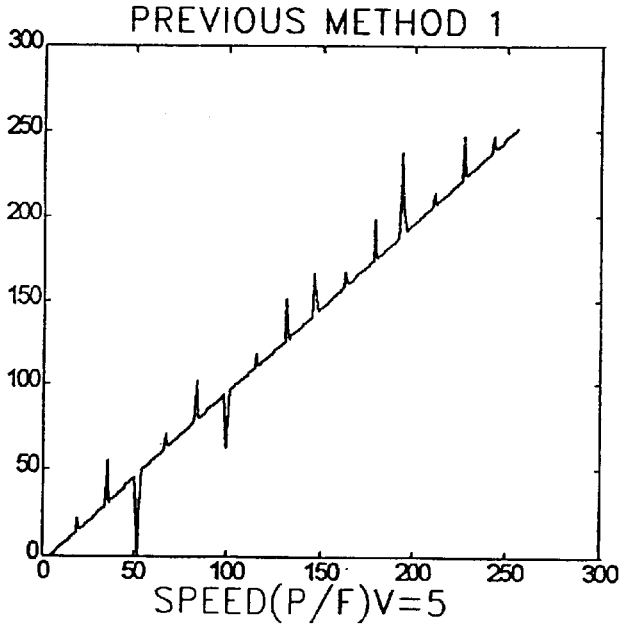
FIG. 13D (PRIOR ART)
Figure 14A:
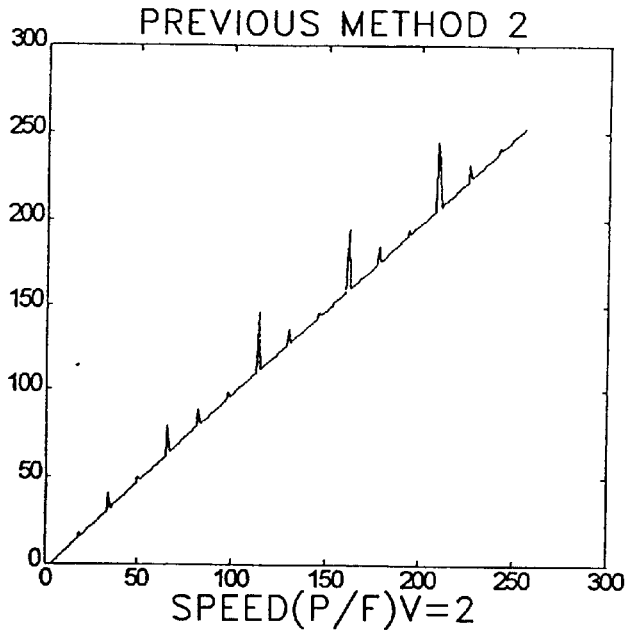
FIG. 14A (PRIOR ART)
FIGS. 14A through 14D are graphs showing resultant luminance distributions displayed by the segmented sub-fields of FIG. 11C when the movement speeds (P/F) of pixels are 2, 3, 4 and 5.
Figure 14B:
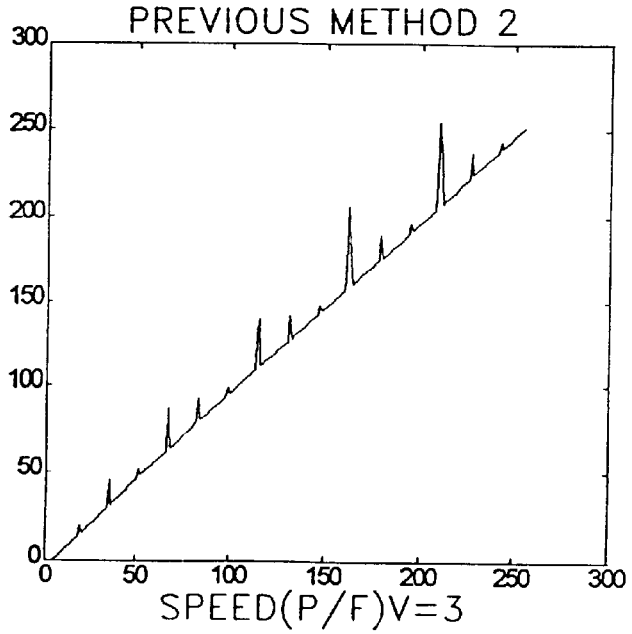
FIG. 14B (PRIOR ART)
Figure 14C:
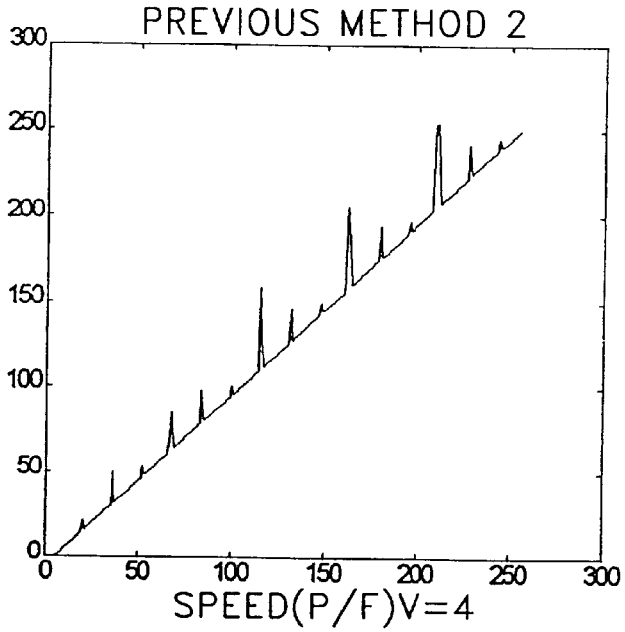
FIG. 14C (PRIOR ART)
Figure 14D:
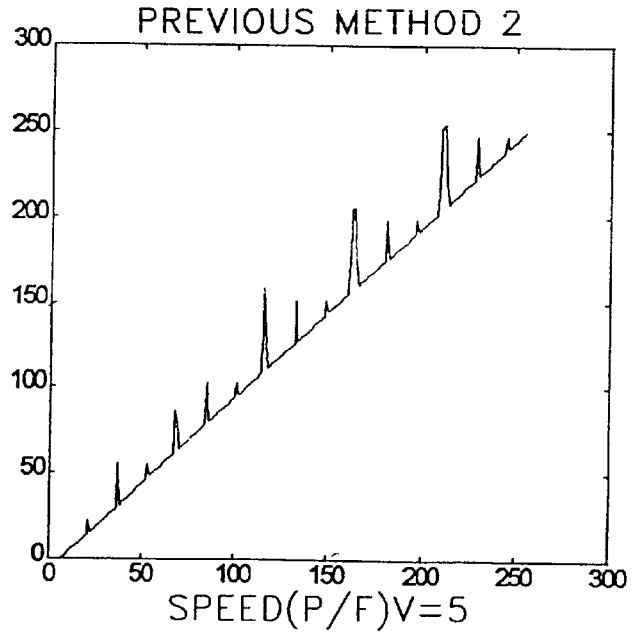
FIG. 14D (PRIOR ART)
Figure 15:
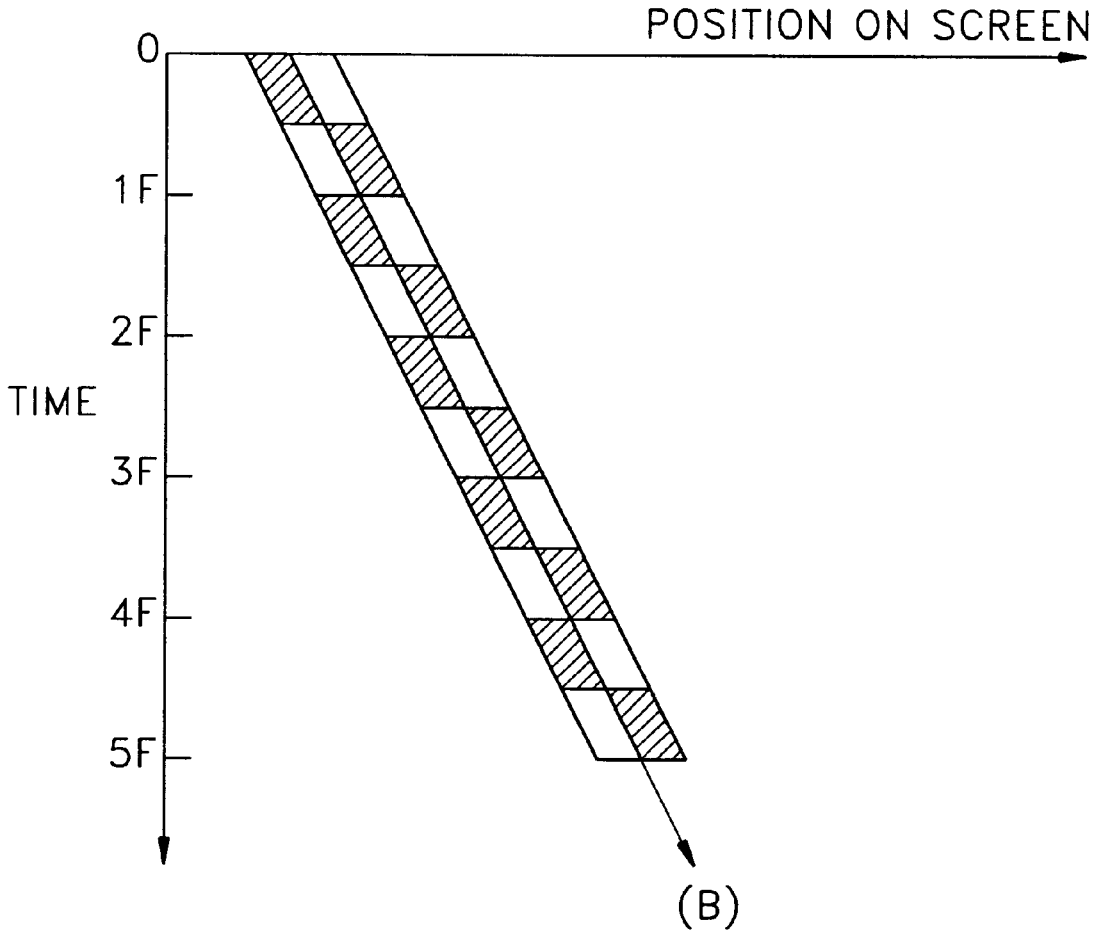
FIG. 15 is a graph showing a method of displaying a gray scale of a plasma display panel according to the present invention, wherein luminance distribution of pixels on a screen according to time is shown.
Figure 16A:
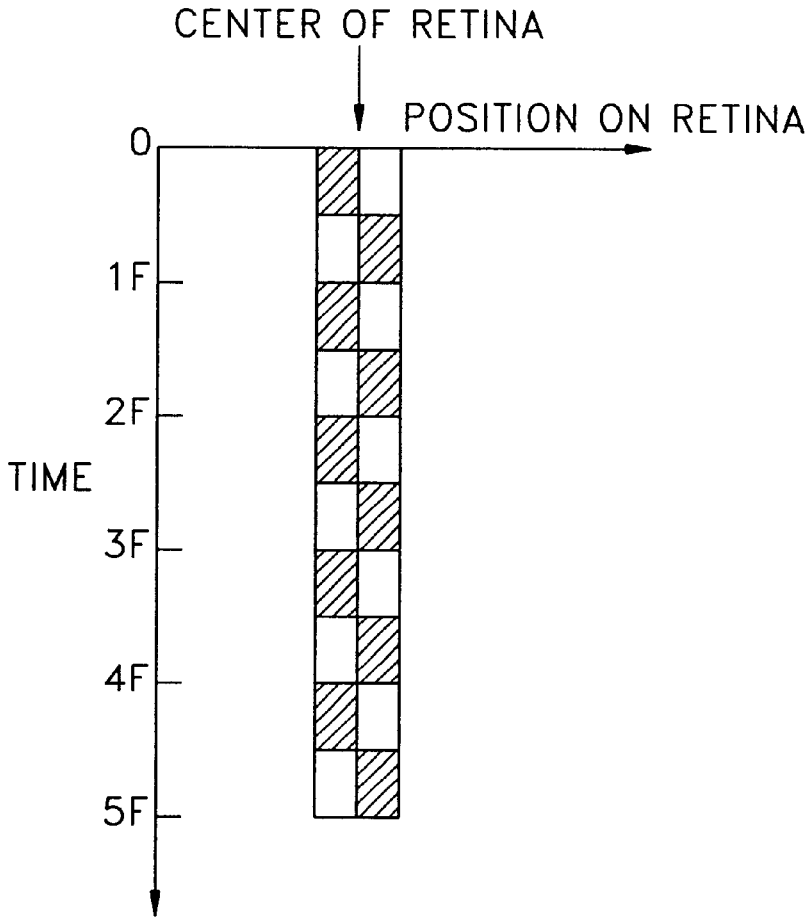
FIGS. 16A and 16B is a view showing luminance distribution landing on the retina of a human eye by the luminance distribution on a screen of FIG. 15, and a graph showing the intensity distribution of visual stimulation according to the luminance distribution landing on the retina of a human eye.
Figure 16B:
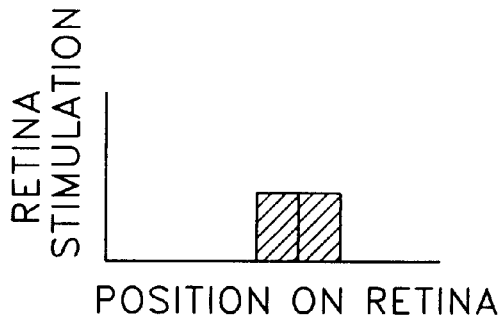

FIG. 15 is a view showing a method of driving a plasma display panel according to the present invention, which illustrates the luminance distribution of pixels on a screen with respect to time. As shown in FIG. 15, the method of driving a plasma display panel according to the present invention is characterized in that pixels on a screen are previously rearranged in accordance with the moving speed of each pixel to prevent inconsistency in the movement of pixels with the movement of the human eye following the pixel movements. This rearrangement of pixels makes the movements of pixels consistent with the movement of the human eye, so that luminance is distributed on the retinas as shown in FIG. 16A. As a consequence, the distribution of visual stimulation on the retinas received by the human eye becomes constant as shown in FIG. 16B, so that the pseudo contour phenomenon is removed.

Figure 17:
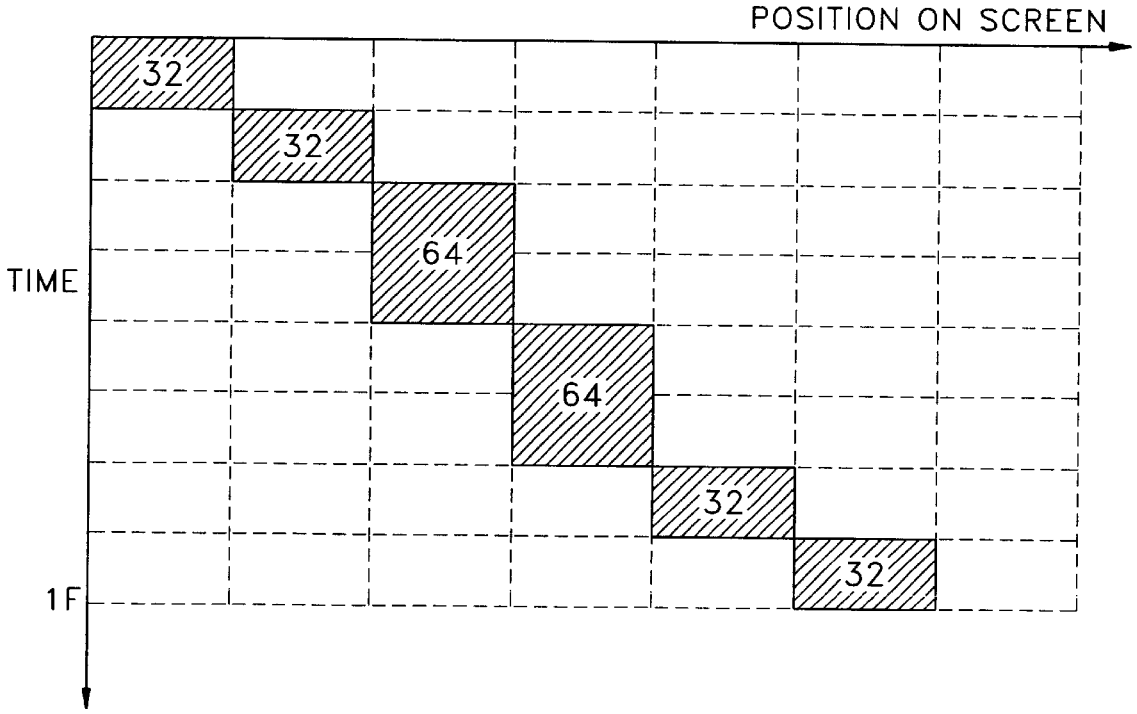
FIG. 17 shows sub-fields combined and spatially arranged so as to be consistent with the movement direction of eyes, in order to substantially accomplish the gray scale display method of FIG. 15.
Figure 18:
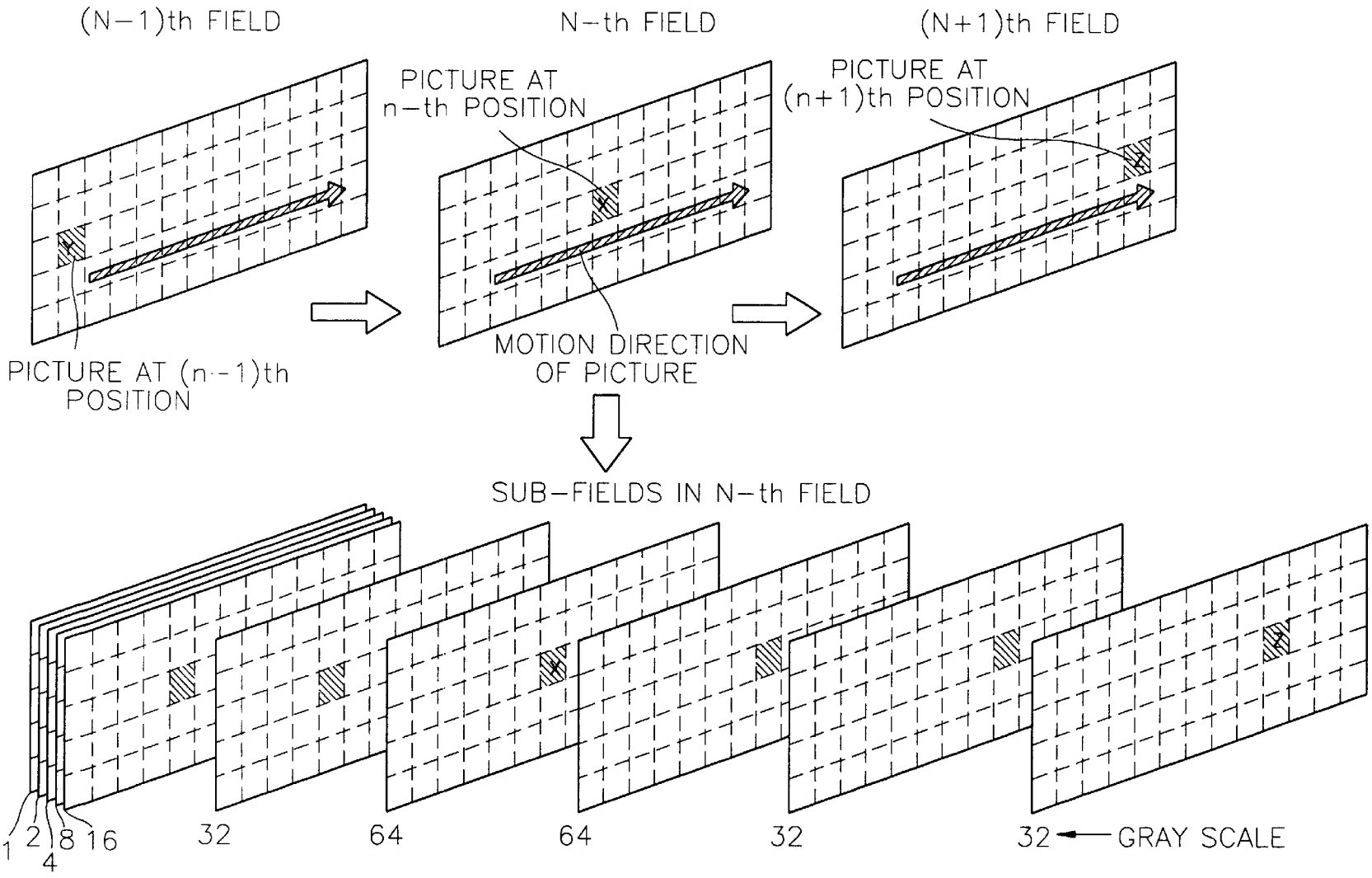
FIG. 18 is a view for explaining a principle in which the embodiment of FIG. 17 is accomplished on a screen.

However, it is practically impossible to give luminance distribution as shown in FIG. 15 to each pixel on a screen formed by combining segmented pixels. Here, the plasma display panel is comprised of temporally segmented sub-fields, so that it can obtain effects such as the principle of the present invention by spatially arranging sub-fields constituting an arbitrary pixel in front of or behind the pixel. FIG. 17, as this embodiment, shows sub-fields which are combined and spatially arranged in a direction in which eyes moves, and FIG. 18 illustrates a principle in which the embodiment of FIG. 17 is accomplished on a screen. That is, in FIG. 18, when the current position of a pixel from which light is to be emitted is set as (x), the position of the pixel at the previous field is set as (y), and the position of the pixel expected to be placed at the very next field is set as (z), sub-fields of the current pixel desired to emit light are dispersed and arranged between the position (y) at the previous field and the position (z) where the pixel is expected to be placed at the very next field, including the positions (y) and (z), as shown in the lower portion of FIG. 18. Accordingly, the arrangement of the sub-fields shown in FIG. 17 is accomplished.

Figure 19A:
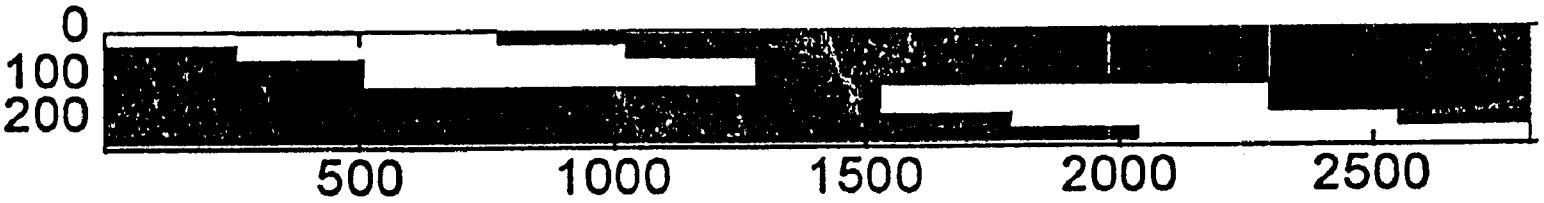
Figure 19B:
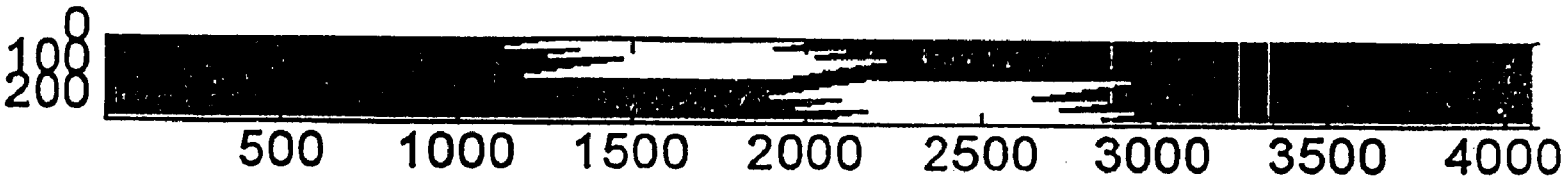
Figure 19C:
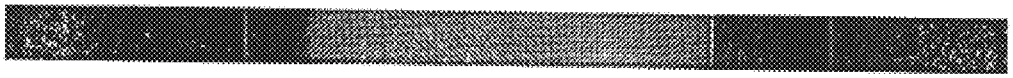
Figure 19D:
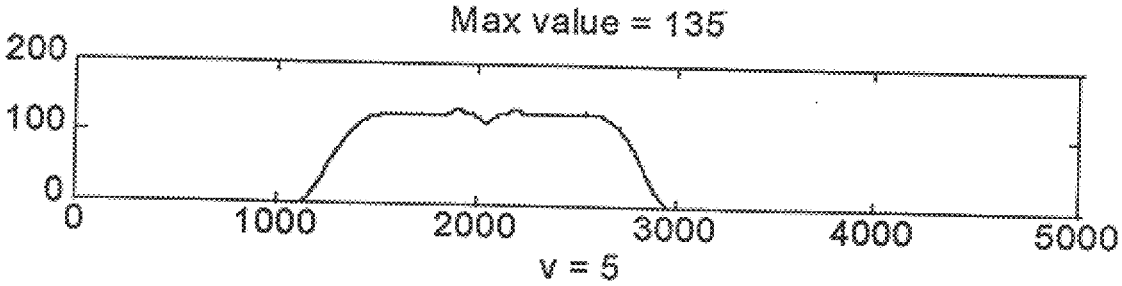

FIGS. 19A through 19D show results of an experiment made on the pseudo contour phenomenon by applying the method of FIG. 17. When a gray scale is expressed by spatially dispersing sub-fields as shown in FIG. 19A, luminance stimulation perceived by the human eye becomes temporally constant, as shown in FIG. 19B, so that a gray scale having reduced pseudo contours is perceived, as shown in FIG. 19C. FIG. 19D shows the intensity distribution of visual stimulation received by the retinas in the above-described case.

Figure 20A:
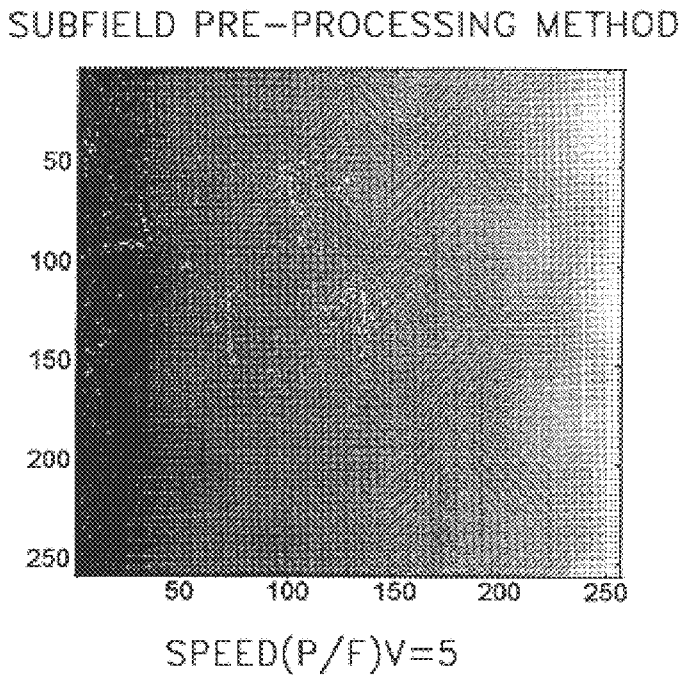
Figure 20B:
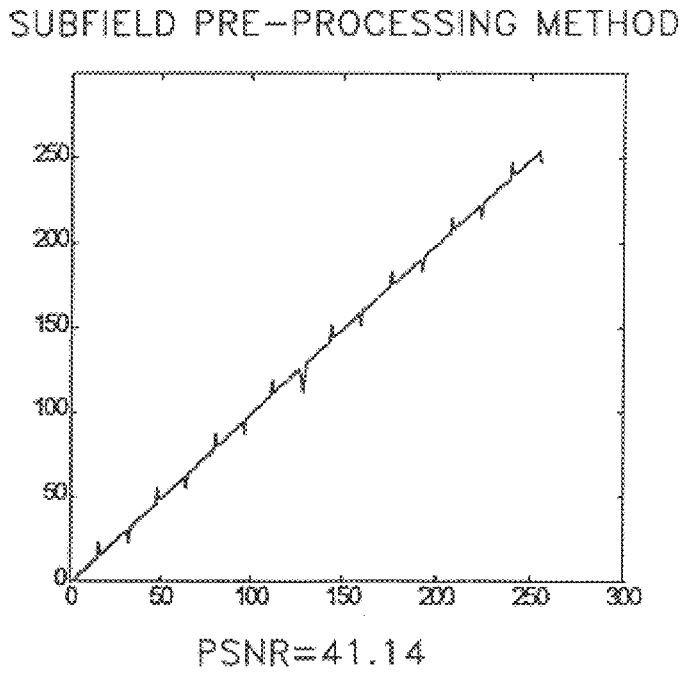

FIGS. 20A and 20B show the results of an experiment made on a gray scale pattern which uniformly changes from 0 to 255 stages in brightness. As shown in FIGS. 20A and 20B, most pseudo contours are reduced when the method of driving a plasma display panel according to the present invention is used. FIG. 20B is a luminance distribution curve in this case, showing that much pseudo contour noise is reduced.

Figure 21A:
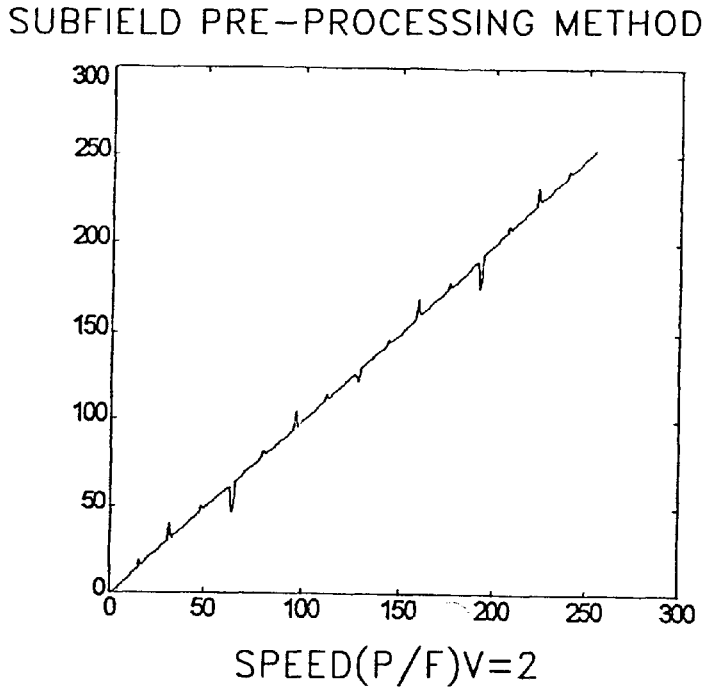
Figure 21B:
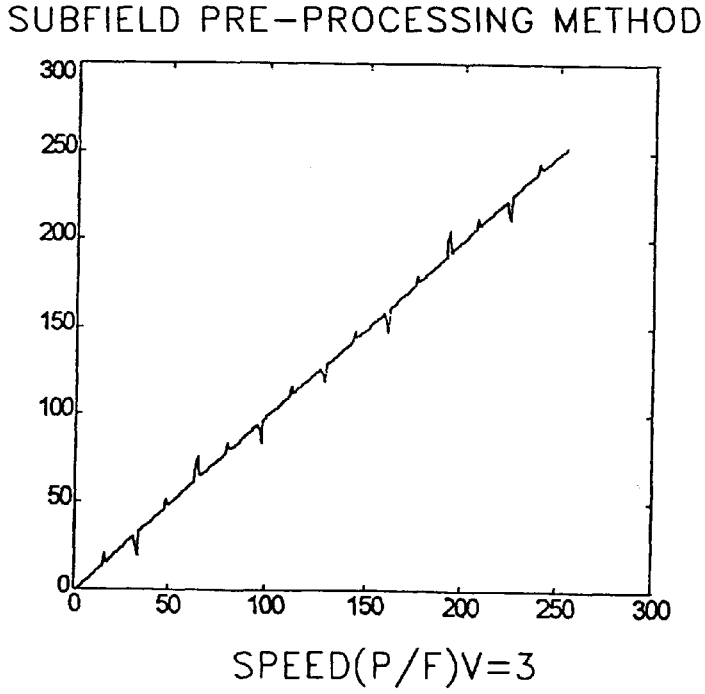
Figure 21C:
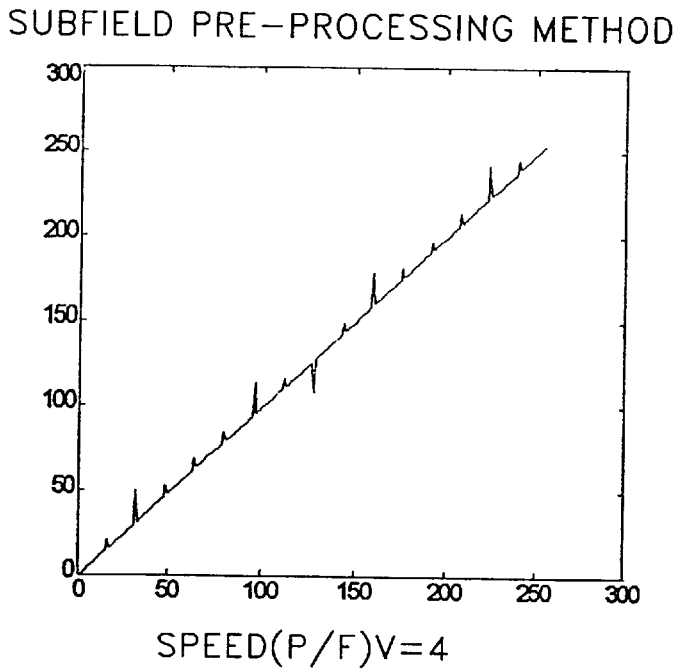
Figure 21D:
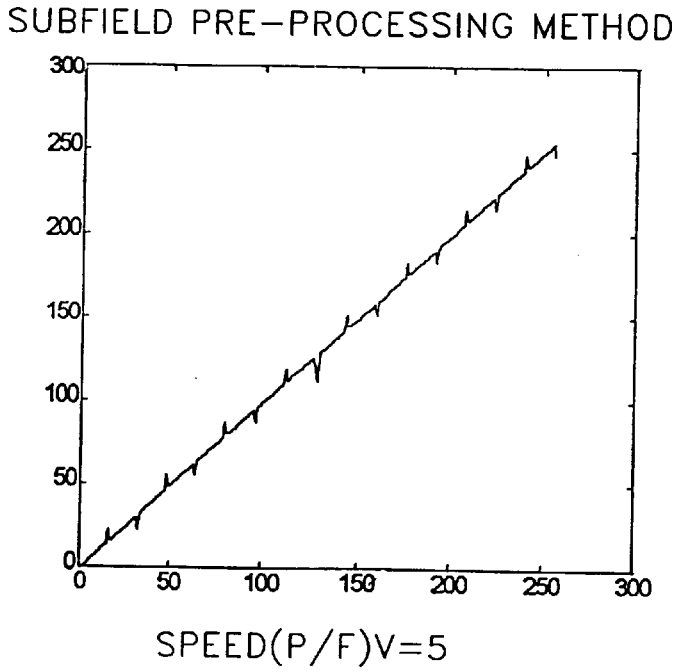

FIGS. 21A through 21D are luminance distribution curves showing the results of an experiment made on the generation characteristics of pseudo contours according to the present invention on a pixel which moves at various speeds. FIG. 21A shows the results when V(P/F) is 2, FIG. 21B shows the results when V(P/F) is 3, FIG. 21C shows the results when V(P/F) is 4, and FIG. 21D shows the results when V(P/F) is 5. Thus, it becomes evident that the pseudo contours do not increase even when the speed increases. This results shows that the plasma display panel driving method according to the present invention can reduce the pseudo contours regardless of the speed of a pixel.

Figure 22:
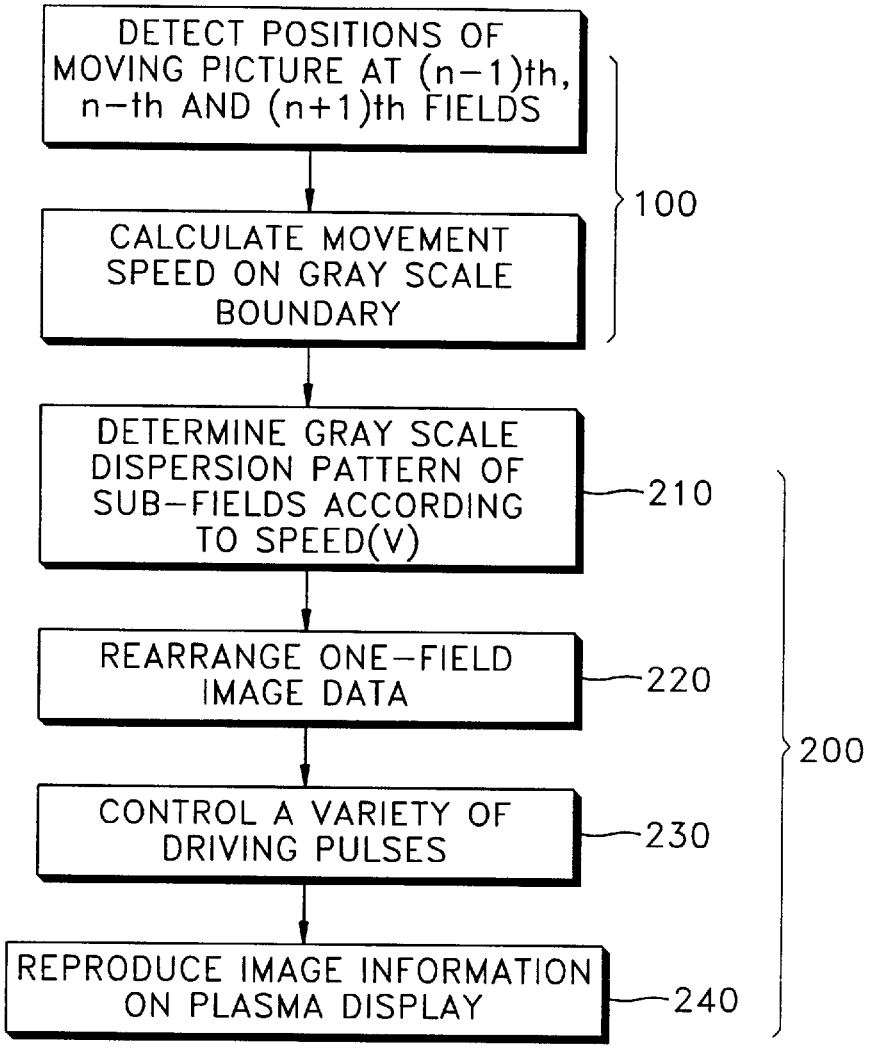
FIG. 22 is a flowchart for applying a method of driving a real plasma display panel according to the present invention.
Figure 24:
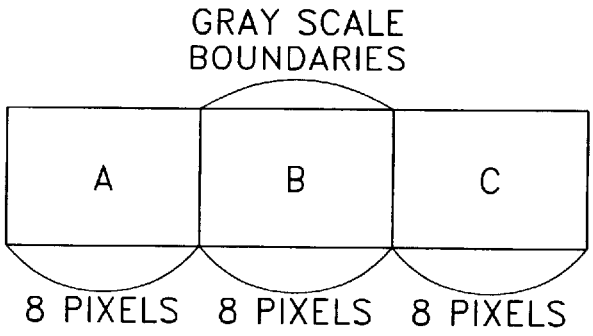
FIG. 24 shows the arrangement relationship of a picture for testing the pseudo contour reducing method according to the present invention in a computer simulation.

FIG. 22 is a flowchart for actually applying the plasma display panel driving method according to the present invention, which can be divided into a process 100 for detecting the movement of a picture and estimating the speed of the picture, and a process 200 for reproducing rearranged image data. The process 200 includes the steps of: finding a pixel dispersion amount appropriate for the obtained speed from a table and determining a pixel dispersion amount (step 210), rearranging pixels on a subfield-by-subfield basis using the determined pixel dispersion amount data (step 220), controlling a variety of driving pulses according to the image data rearranged on a subfield-by-subfield basis (step 230), and realizing the rearranged image data on a plasma display (step 240). Here, the process 100 for estimating the movement of a picture is a well-known digital signal processing (DSP) technique.

Figure 23A:
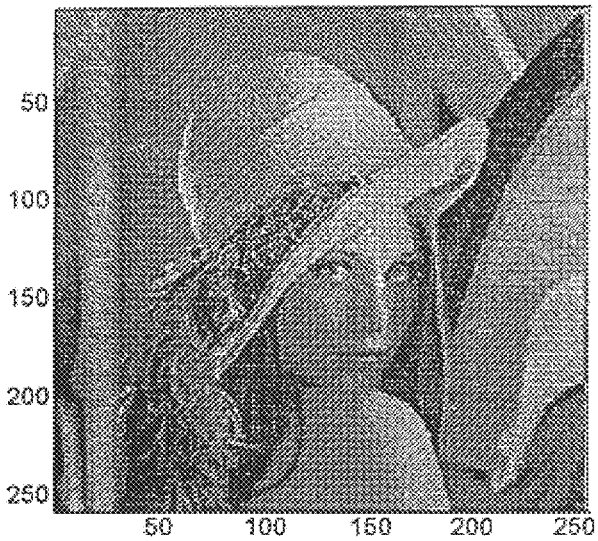
Figure 23B:
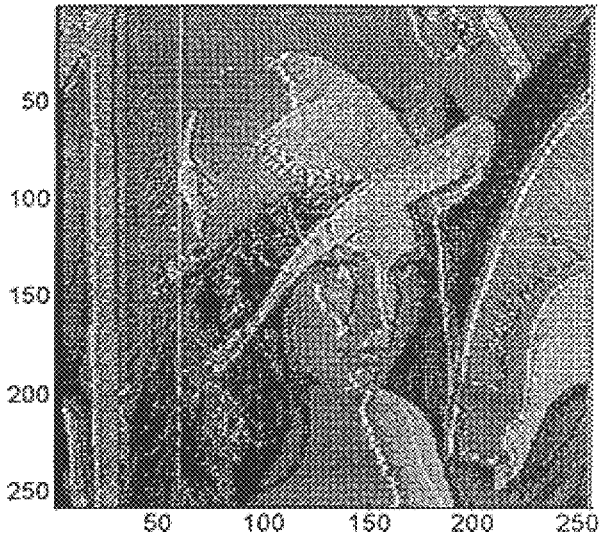
Figure 23C:
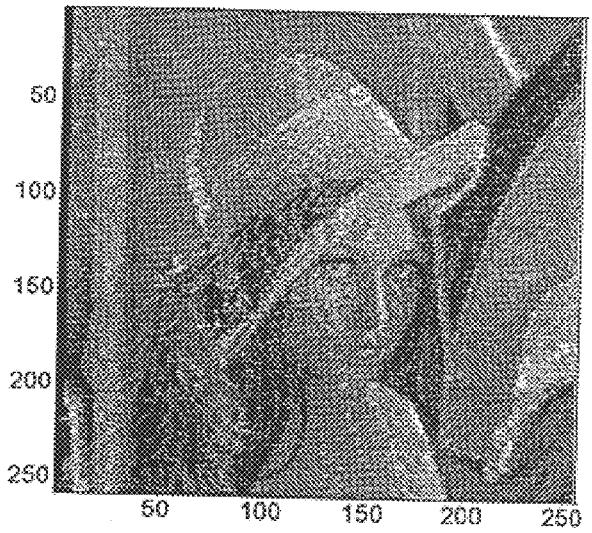
Figure 23D:
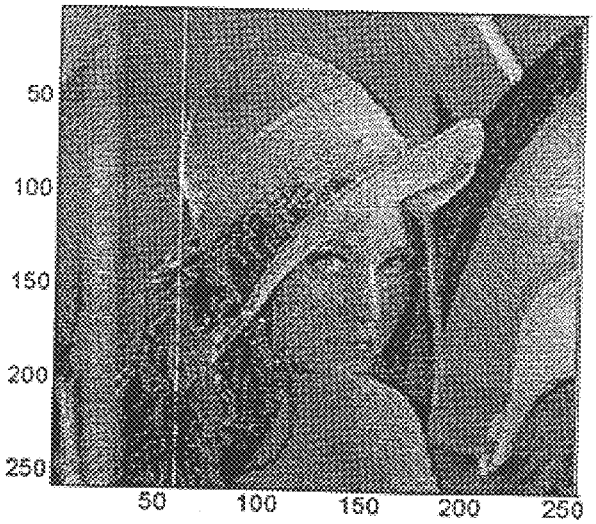

FIGS. 23A through 23D show the results of an experiment made with a test picture to verify the effects of the plasma display panel driving method according to the present invention. In the case that there is no countermeasures for reducing pseudo contours, pseudo contour phenomenon becomes serious, as shown in FIG. 23B, when an original image, as shown in FIG. 23A, moves from left to right. When a conventional pseudo contour reduction countermeasure is applied, pseudo contours still exist, as shown in FIG. 23C. When a pseudo contour reduction countermeasure according to the present invention is applied, few pseudo contours exist, as shown in FIG. 23D. Thus, FIG. 23D shows a test picture as shown in FIG. 23A.

Pseudo contours are also generated on a display for expressing a gray scale by varying the light emitting time in time division since the luminance of output light cannot be varied. Thus, the present invention can be applied not only to picture realization of a plasma display panel but also to a display device (digital micro mirror device or a ferroelectric liquid crystal display device) having the same gray scale expression system as the plasma display panel, so that a reduction in pseudo contour can be expected in these display devices.

FIG. 24, FIGS. 25A and 25B, FIGS. 26A and 26B, FIGS. 27A and 27B, and FIGS. 28A and 28B are graphs showing the breaking of a gray scale at the boundary between gray scale pictures A and B or B and C, three pictures having different brightnesses, the breaking estimated by computer simulation. That is, FIGS. 25A and 25B, FIGS. 26A and 26B, FIGS. 27A and 27B, and FIGS. 28A and 28B show estimated breaking degrees of a gray scale at the boundaries (the boundary between gray scale pictures A and B and the boundary between gray scale pictures B and C) between pictures A, B and C each comprised of 8 pixels having the same gray scales and having a different brightness level. Here, each of the pictures A and C includes picture data (still pixels) which have not been rearranged, and picture B includes pixel data which have been rearranged with respect to a given speed. The test model of these pictures is comprised of sub-fields in a ratio of 1: 2: 4: 8: 16: 32: 64: 64: 32: 32, and the test data thereof uses 24 (3□) pixels in width and one pixel in length. The last three sub-fields 64: 32: 32 are obtained by dividing a subfield of 128 gray scales into three subfields to meet the purpose of the present invention.

FIGS. 25A, 26A, 27A and 28A show the results of a pixel located before and behind an n-th position in consideration of (n−1)th and (n+1)th positions by a method according to the present invention, and FIGS. 25B, 26B, 27B and 28B show results of a pixel located between (n−1)th and n-th positions by a method according to the prior art. In the drawings, bar graphs denote the gray scale values of pixels, and pictures over the bar graphs show simulation picture patterns.

Figure 25A:
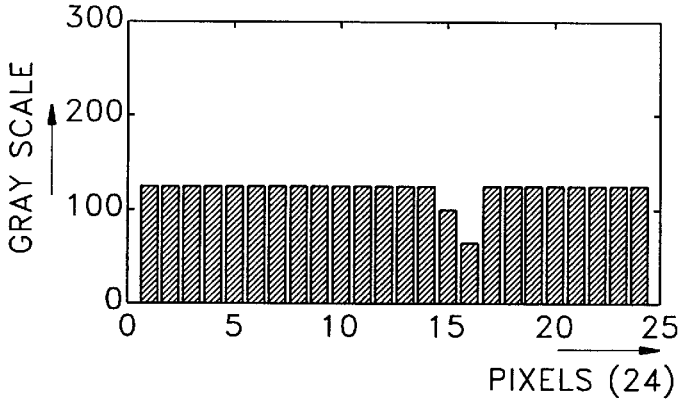
FIGS. 25A and 25B, FIGS. 26A and 26B, FIGS. 27A and 27B, and FIGS. 28A and 28B are graphs showing the breaking of a gray scale at the boundary between gray scale pictures A and B or B and C of FIG. 24, three pictures having the same brightness or different brightness, the breaking estimated by computer simulation when the movement speed of the middle picture B is set as 5 and both pictures on the left and the right are set as still pictures.
Figure 25B:
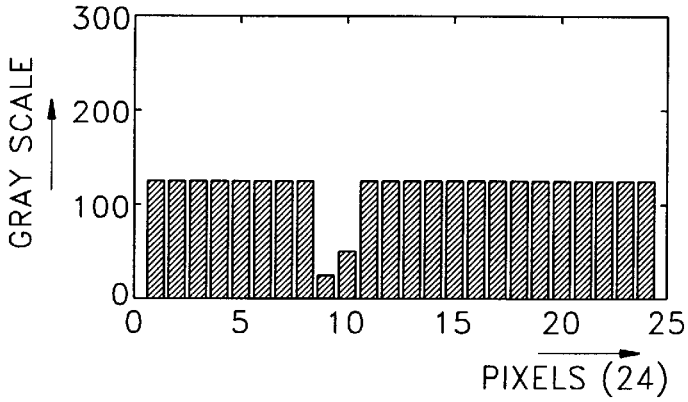

In FIGS. 25A and 25B, the gray scale values of a total of 24 pixels used in simulation are set to be 127, and the movement speed V of picture B (8 intermediate pixels) is set to be 5. In the method according to the present invention, the gray scale value is lowered in the middle, and a peak signal-to-noise ratio (PSNR) was 25.0044. In the method according to the prior art, the gray scale value is lowered in the first half, and the PSNR was 20.6905.

Figure 26A:
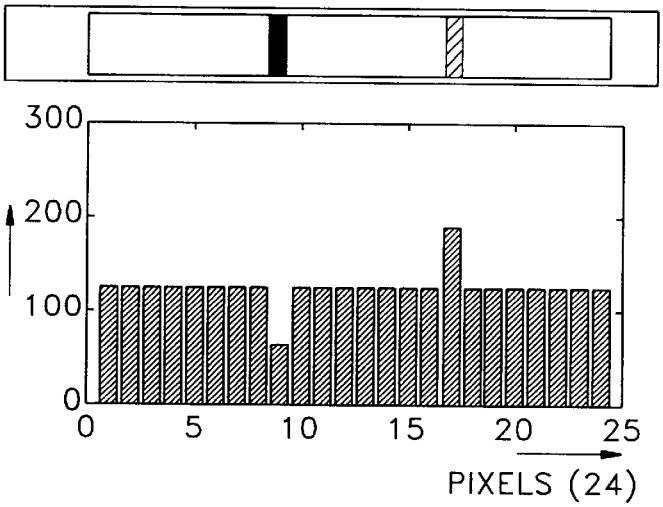
Figure 26B:
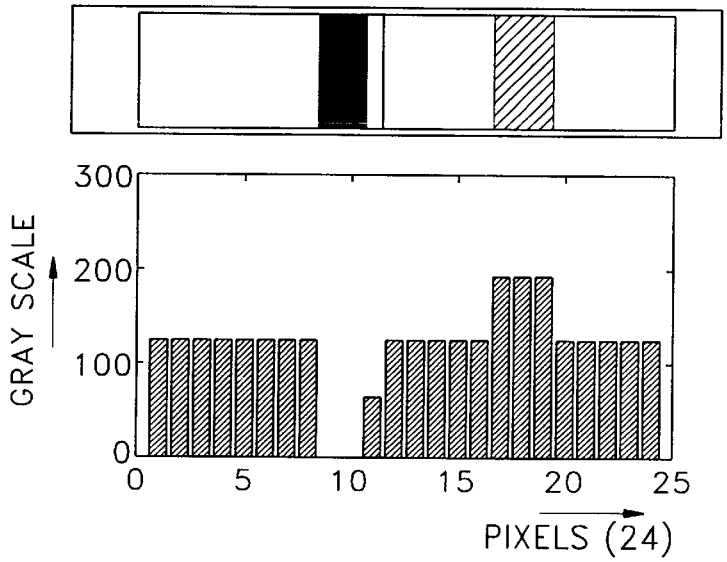

In FIGS. 26A and 26B, the gray scale values of 16 pixels in the still pictures A and C among the total of 24 pixels used in simulation are set to be 127, the gray scale values of 8 pixels of the middle moving picture B are set to be 128, and the movement speed V of the intermediate moving picture B is set to be 5. In the method according to the present invention, the gray scale value is lowered in the middle, and the PSNR was 22.799. In the method according to the prior art, the gray scale value is lowered in the first half, and the PSNR was 15.0175.

Figure 27A:
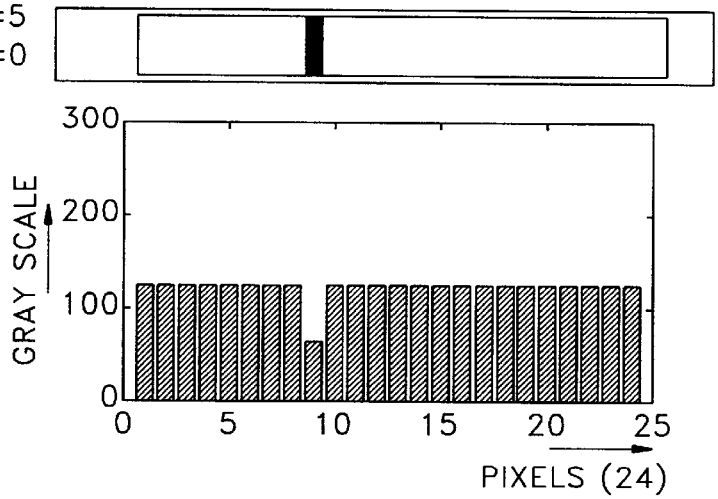
Figure 27B:
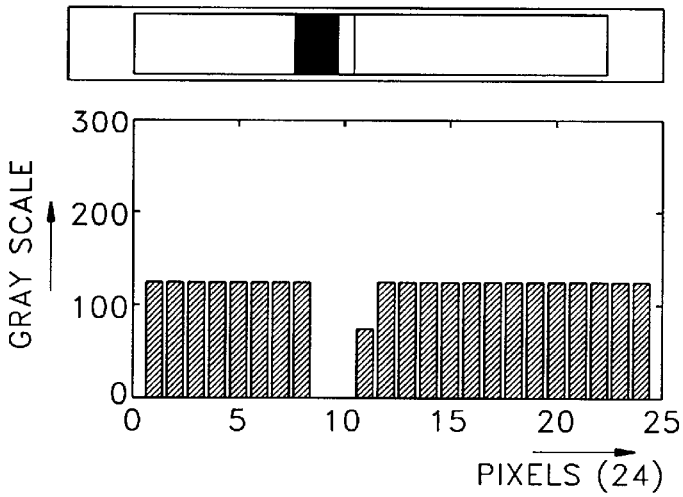

In FIGS. 27A and 27B, the gray scale values of a total of 24 pixels used in simulation are set to be 128, and the movement speed V of picture B (8 intermediate pixels) is set to be 5. In the method according to the present invention, the gray scale value is lowered in the middle, and the PSNR was 25.8093. In the method according to the prior art, the gray scale value is lowered in the first half, and the PSNR was 16.2669.

Figure 28A:
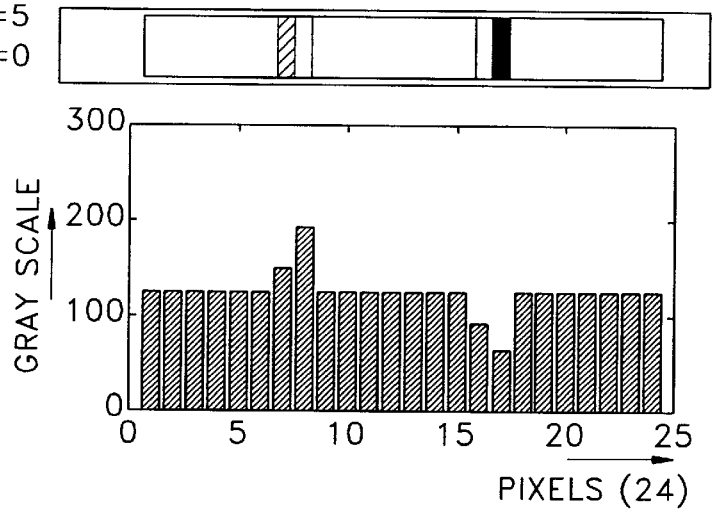
Figure 28B:
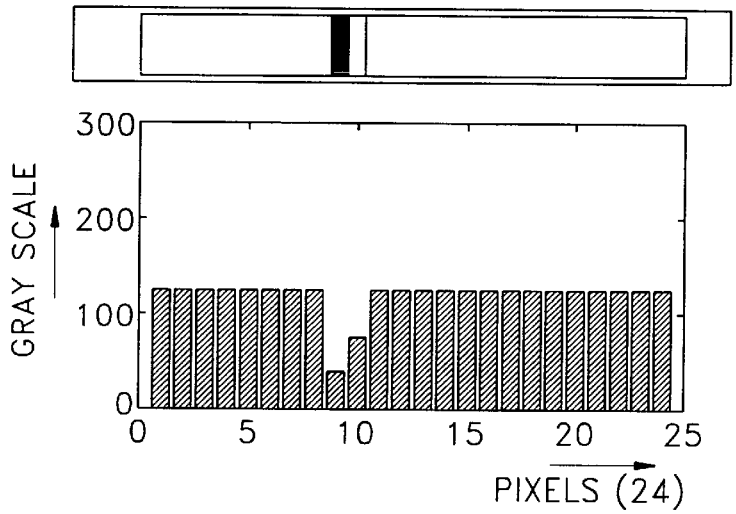

In FIGS. 28A and 28B, contrary to FIGS. 26A and 26B, the gray scale values of 16 pixels in the still pictures A and C among the total of 24 pixels used in simulation are set to be 128, the gray scale values of 8 pixels of the middle moving picture B are set to be 127, and the movement speed V of the intermediate moving picture B is set to be 5. In the method according to the present invention, the gray scale value is lowered in the middle, and the PSNR was 21.9941. In the method according to the prior art, the gray scale value is lowered in the first half, and the PSNR was 20.6898. These simulation results show that a better PSNR is obtained in the rearrangement method according to the present invention than in the method according to the prior art, regardless of whether the gray scale of the moving picture B is the same as or different from the gray scales of the still pictures A and B adjacent to the moving picture B.

Figure 29:
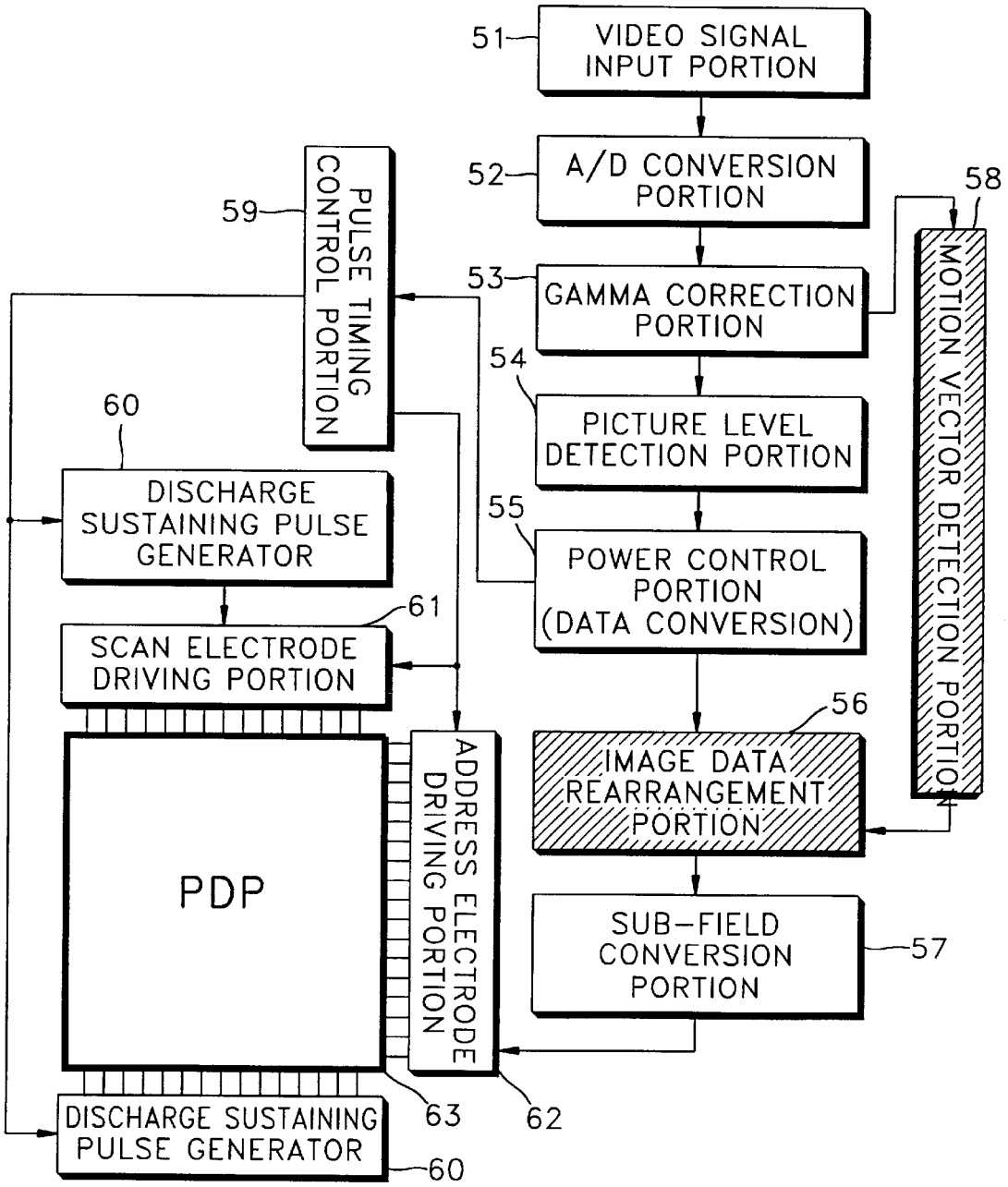
FIG. 29 is a block diagram showing the schematic configuration of an apparatus for displaying a gray scale of a plasma display panel according to the present invention.

FIG. 29 is a block diagram showing the schematic configuration of an apparatus for displaying a gray scale of a plasma display panel according to the present invention. Referring to FIG. 29, this apparatus includes a video signal input portion 51, an analog-to-digital (A/D) conversion portion 52, a gamma correction portion 53, a picture level detection portion 54, a power control portion (APC) (data conversion portion) 55, a data rearrangement portion 56, a sub-field conversion portion 57, a motion vector detection portion 58, a pulse timing control portion 59, a discharge sustain pulse generator 60, a scan electrode driving portion 61, an address electrode driving portion 62, and a plasma display panel (PDP) 63.

The video signal input portion 51 separates only a pure video signal from a composite video signal such as those in TVs or VCRs, and provides the separated pure video signal to the A/D conversion portion 52. The A/D conversion portion 52 converts the separated analog signal into a digital video signal. The gamma correction portion 53 corrects the video signal suitable for the driving characteristics of CRTs to a video signal suitable for the characteristics of PDPs. The picture level detection portion 54 detects the entire brightness of a picture. The power control portion (data conversion portion) 55 has the APC function. The motion vector detection portion 58 and the data rearrangement portion 56 are the characteristic portions of the apparatus for displaying a gray scale of a plasma display panel according to the present invention. The motion vector detection portion 58 detects the motion speed of a picture as a directional vector and outputs the detected motion vector to the data rearrangement portion 56. The data rearrangement portion 56 disperses pixel data to several sub-fields according to the directional vector of the picture and rearranges the pixel data. The sub-field conversion portion 57 rearranges image information on each sub-field. The pulse timing control portion 59 generates a reference timing signal of a driving pulse for driving the electrodes of the PDP, on the basis of a signal provided from the power control portion 55. The discharge sustaining pulse generator 60 generates a discharge sustaining pulse for driving discharge sustaining electrodes, on the basis of a reference timing signal provided from the pulse timing controller 59. The scanning electrode driving portion 61 directly drives scanning electrodes using the discharge sustaining pulse. The address electrode driving portion 62 drives address (data) electrodes using the reference timing signal provided by the pulse timing control portion 59 and the sub-field image information provided by the sub-field conversion portion 57.

As described above, the method of display a gray scale of a plasma display panel according to the present invention can prevent generation of pseudo contours of dark lines (or bright lines) that temporal inconsistency appears as spatial inconsistency, at a portion of a moving picture in which the gray scale change is subtle, when expressing a gray scale by temporal duplication of light emission using the after-image effect of vision. In view of the fact that pseudo contour is generated because the movement of a pixel is not consistent with the movement of the human eye, and thus a temporal change in luminance is shown as dispersion of luminance on the retina, the present invention redistributes a plurality of sub-fields each having a luminance of one cell, to several cells, as many sub-fields corresponding to the inconsistency of the detected movement of a pixel with the movement of the eye. Whereby, the movement of a pixel can be approximately consistent with the movement of the eye. Consequently, the retinas can perceive the temporal stimulation of an original picture, so that pseudo contour phenomenon is reduced regardless of the moving speed of a picture.

What is claimed is:

1. A method of displaying a gray scale by time-division on a plasma display panel, including:

dividing a picture in each field displayed on the plasma display panel into a plurality of sub-fields such that each sub-field has a temporally different discharge sustaining period to display the gray scale by combinations of the sub-fields;

dispersing and arranging image information representing a picture at an arbitrary position of a first field, to each of the sub-fields constituting the first field, wherein the image information position in each of the sub-fields sequentially moves from a first display position where the image information has been displayed on a field immediately before the first field, to a third display position where the image information is expected to be displayed on a field immediately after the first field, via a second display position where the image information is displayed on the first field; and, determining the position of the image information displayed in each of the sub-fields so that the image information sequentially moves from the first display position to the third display position in response to moving speed of the image information among the first, second, and third display positions.

2. The method of claim 1, including determining the image information position on each of the sub-fields so that the image information sequentially moves from the first display position to a position before the second display position in sub-fields corresponding to a first half of a corresponding field, and the image information sequentially moves from the second display position to the third display position in sub-fields corresponding to a second half of the corresponding field.

3. The method of claim 2, including setting the position of the image information in each of the sub-fields at a position where the image information moves, in response to control information determined by characteristic values of sub-fields constituting the corresponding field.

4. The method of claim 2, including determining the position of the image information in each of the sub-fields so that luminance temporally appears consistent or nearly consistent with respect to display time of the corresponding field.

5. The method of claim 4, including determining the discharge sustaining period of each of the sub-fields so that luminance temporally appears consistent or nearly consistent with respect to the display time of the corresponding field.

6. A method of displaying a gray scale by time-division of a plasma display panel, including;

dividing a picture in each field displayed on the plasma display panel into a plurality of sub-fields such that each sub-field has a temporally different discharge sustaining period to display the gray scale by combinations of the sub-fields;

dispersing and arranging image information representing a picture at an arbitrary position of a first field, to each of the sub-fields constituting the first field, wherein the image information position in each of the sub-fields sequentially moves from a first display position where the image information has been displayed on a field immediately before the first field, to a third display position where the image information is expected to be displayed on a field immediately after the first field, via a second display position where the image information is displayed on the first field; and when a field immediately before the field on which the first display position exists is called a zero order field, and a field just before the zero order field is called a −1 order field, detecting motion of the zero order field or motions of the zero order and −1 order fields, estimating position of image information displayed on each of the sub-fields by a motion vector on a straight line or a curve of motion detected between the first and third display positions, via the second display position, and determining image information position displayed on each of the sub-fields by the estimating so that the image information sequentially moves from the first display position to the third display position via the second display position.

7. An apparatus for displaying a gray scale by time-division on a plasma display panel, a picture on each field displayed on the plasma display panel being divided into a plurality of sub-fields, each of the sub-fields having a temporally different discharge sustaining period, the gray scale being displayed by combinations of the different discharge sustaining periods, the apparatus comprising:

a video signal input portion for separating a pure video signal from a composite video signal;

an analog-to-digital (A/D) converter for converting an analog video signal, separated by the video signal input portion, into a digital video signal;

gamma correction means for correcting the digital video signal supplied by the A/D converter for driving a cathode ray tube, to a gamma-corrected signal for driving a plasma display panel;

picture level detection means for detecting total brightness of a picture from the gamma-corrected signal;

a power controller for converting data of a video signal provided by the picture level detection means, the power controller having a power control function;

motion vector detection means for detecting a moving direction and speed of corresponding image information by comparison of image display information received at a corresponding field with image information received at a field prior to the corresponding field, in each field of the gamma-corrected signal;

picture data rearrangement means for dispersing and rearranging pixel data provided by the power controller to several sub-fields according to the moving direction and speed, provided by the motion vector detection means;

a sub-field converter for rearranging pixel data rearranged by the picture data rearrangement means in each sub-field;

pulse timing control means for generating a reference timing signal for a driving pulse for driving electrodes of a plasma display panel based on a signal provided by the power controller;

discharge sustaining pulse generation means for generating a discharge sustaining pulse for driving discharge sustaining electrodes of the plasma display panel based on the reference timing signal provided by the pulse timing control means;

scanning electrode driving means for directly driving scanning electrodes of the plasma display panel using the discharge sustaining pulse; and address electrode driving means for driving address electrodes of the plasma display panel using the reference timing signal provided by the pulse timing control means and a sub-field video signal provided by the sub-field converter.

8. The apparatus of claim 7, wherein the picture data rearrangement means comprises:

means for moving image information displayed in each of the sub-fields at the speed detected and in the moving direction detected;

means for storing display information moved with respect to information within one field; and means for reconstructing image information for one field using the display information stored.

* * * * *